US010850876B2

(12) United States Patent
Palumbo et al.

(10) Patent No.: US 10,850,876 B2
(45) Date of Patent: Dec. 1, 2020

(54) APPARATUS AND PROCESS FOR PACKAGING PRODUCTS

(71) Applicant: CRYOVAC, INC., Duncan, SC (US)

(72) Inventors: Riccardo Palumbo, Arona (IT); Giulio Benedetti, Solbiate Arno (IT)

(73) Assignee: Cryovac, LLC, Charlotte, NC (US)

( * ) Notice: Subject to any disclaimer, the term of this patent is extended or adjusted under 35 U.S.C. 154(b) by 350 days.

(21) Appl. No.: 15/580,460

(22) PCT Filed: Jun. 9, 2016

(86) PCT No.: PCT/IB2016/053388
§ 371 (c)(1),
(2) Date: Dec. 7, 2017

(87) PCT Pub. No.: WO2016/199050
PCT Pub. Date: Dec. 15, 2016

(65) Prior Publication Data

US 2018/0178932 A1 Jun. 28, 2018

(30) Foreign Application Priority Data

Jun. 9, 2015 (IT) ..... 102015000021960

(51) Int. Cl.
*B65B 9/04* (2006.01)
*B65B 41/12* (2006.01)
(Continued)

(52) U.S. Cl.
CPC ..... *B65B 9/04* (2013.01); *B65B 5/02* (2013.01); *B65B 5/04* (2013.01); *B65B 7/164* (2013.01);
(Continued)

(58) Field of Classification Search
CPC .... B65B 9/04; B65B 5/02; B65B 5/04; B65B 7/164; B65B 41/12; B65B 65/00; B65B 65/003
(Continued)

(56) References Cited

U.S. PATENT DOCUMENTS 3,733,773 A * 5/1973 Hamilton ..... B29C 51/261 53/559
3,808,772 A * 5/1974 Turtschan ..... B29C 51/20 53/141
(Continued)

FOREIGN PATENT DOCUMENTS

CN 102574591 7/2012
CN 103930349 7/2014
(Continued)

*Primary Examiner* — Dariush Seif
(74) *Attorney, Agent, or Firm* — Jason R. Womer

(57) ABSTRACT

It is described an apparatus (1) for packaging a product (P) comprising: a forming station (2) configured for receiving a base film (3) and for forming with it a precursor body (4) having a plurality of tray-shaped elements (5) adjacent to each other, and a packaging station (8) configured for receiving said precursor body (4) and a closing film (9), the packaging station (8) being configured for attaching the closing film (9) to the precursor body (4) at least at an upper opening (5*a*) of a predetermined number of said tray-shaped elements (5) for forming packages (C) flanked to each other. A movement device (13) is configured for moving at least one of said forming (2) and packaging stations (8), for conferring to the precursor body (4) a step-by-step discontinuous movement along a predetermined advancement path (T). It is also described a packaging process using the apparatus (1).

24 Claims, 12 Drawing Sheets

(51) Int. Cl.
*B65B 7/16* (2006.01)
*B65B 65/00* (2006.01)
*B65B 5/02* (2006.01)
*B65B 5/04* (2006.01)

(52) U.S. Cl.
CPC ..... *B65B 41/12* (2013.01); *B65B 65/00* (2013.01); *B65B 65/003* (2013.01)

(58) Field of Classification Search
USPC ..... 53/453, 473, 559, 452, 450, 467, 456, 53/329.3
See application file for complete search history.

(56) References Cited

U.S. PATENT DOCUMENTS 3,979,877 A * 9/1976 Vetter ..... B65B 9/04 53/51
4,033,092 A * 7/1977 Vetter ..... B29C 31/004 53/77
4,069,645 A * 1/1978 Vetter ..... B29C 51/26 53/511
4,349,997 A * 9/1982 Hayasaka ..... B65B 41/18 156/351
4,726,173 A * 2/1988 Giatti ..... B65B 9/04 53/559
4,951,447 A * 8/1990 Denda ..... B65B 11/54 53/131.2
5,269,123 A * 12/1993 Marchesini ..... B29C 65/18 53/329.4
5,517,805 A * 5/1996 Epstein ..... B65B 31/021 53/453
6,085,497 A * 7/2000 Natterer ..... B65B 65/02 53/373.7
7,607,281 B2 * 10/2009 Freddi ..... B65B 7/164 53/281
10,065,755 B2 * 9/2018 Palumbo ..... B65B 57/00
2005/0252351 A1 * 11/2005 Natterer ..... B65B 9/04 83/39
2005/0257501 A1 * 11/2005 Natterer ..... B65B 31/028 53/432
2007/0022717 A1 * 2/2007 Seggern ..... B29C 65/7451 53/433
2007/0186512 A1 * 8/2007 Rimondi ..... B65B 9/073 53/441
2007/0220833 A1 * 9/2007 Freddi ..... B65B 7/164 53/452
2012/0289388 A1 * 11/2012 Ehrmann ..... B29C 33/30 483/1
2013/0199128 A1 * 8/2013 Rochon ..... B41J 3/407 53/131.5
2014/0150377 A1 * 6/2014 Ehrmann ..... B65B 47/02 53/453
2014/0165511 A1 * 6/2014 Eberle ..... B65B 47/04 53/559
2014/0237942 A1 * 8/2014 Geble ..... B29C 65/7841 53/285
2016/0194101 A1 * 7/2016 Palumbo ..... B65B 9/04 53/433
2016/0355283 A1 * 12/2016 Capitani ..... B29C 66/91421

FOREIGN PATENT DOCUMENTS

CN 104395194 3/2015
CN 104470807 3/2015
CN 104925304 9/2015
DE 2146835 3/1973
EP 0370970 5/1990
EP 0569933 11/1993
EP 1506924 2/2005
EP 2389330 B1 * 3/2017 ..... B65G 47/61

* cited by examiner

APPARATUS AND PROCESS FOR PACKAGING PRODUCTS

TECHNICAL FIELD

The present invention refers to an apparatus and process for packaging a product. Particularly, the process and apparatus, object of the invention, provide a forming station by which trays are in-line formed from a film material. According to some aspects of the invention, the invention can provide an apparatus and process for packaging a product in a controlled atmosphere.

State of the Art

Packages comprising a tray on the top of which a closing film is attached, are used for packaging foods and a great variety of other articles. The known type containers can be for example made of plastics, metal, or combinations thereof, while the lids typically consist of plastic films attached to the tray by thermosealing. The plastic film can be cut after attaching it to the tray, in other words is precut and then attached to the upper flange of the tray.

A type of apparatuses and of associated packaging processes comprises to in-line thermoform the trays. In other words, a base plastic film destined to form the trays, is advanced towards a forming station, wherein such base film is thermoformed for defining one or more consecutive trays which, once suitably filled with respective products, are advanced towards a packaging station. A further closing film is moved towards the packaging station and is attached on the trays. At the packaging station, a vacuum can be provided and/or a controlled atmosphere can be generated inside the tray.

The base films and thermoformed trays can be for example moved by using systems of chains and pliers active on the two longitudinal sides of the apparatus, as illustrated in U.S. Pat. Nos. 4,069,645 and 4,033,092. The chains-pliers system provides to engage the longitudinal edges of the base film and of the continuous artifact exiting the forming station: the pliers elements require a minimum area of the edge for pulling the forming artifact. The longitudinal edges on which the pliers act are then removed from the completed pack, so that it is required a further processing step, further determining a substantial quantity of scrapped material.

On the contrary, according to what is disclosed in U.S. Pat. No. 4,726,173, pulling the base film in which the trays were thermoformed, is performed by a combined movement of pliers active on the longitudinal edges of the artifact, and a movement system active on the forming station, cutting station, tray sealing station. The combined operation of the pliers pulling system and movement system of the stations substantially ensures a continuous and smooth movement of the base film. However, it is to be noted that the above described apparatus requires also to pinch the longitudinal edges of the film which, therefore, should be removed from the finished product which in turn entails the same above described disadvantages. Moreover, the complexity of the mechanisms implies a heavy structure and consequently not negligible manufacturing costs. Lastly, the mechanical complexity and the scarce flexibility of the discussed apparatus, make difficult, or impossible, to adapt the apparatus for forming and therefore conveying trays of different shapes and size.

Lastly, document WO2015011076 shows a packaging apparatus wherein a base film is thermoformed for defining adjacent trays, then on or more products are introduced in the trays themselves and lastly a closing film is applied on the trays. By this approach, the forming and packaging stations are stationary, instead suitable advancing means active on the forming films are provided which comprise movable plates grippingly acting on the base film and/or closed trays, always at the areas of the films distinct from the ones wherein the trays are present in order to apply a step-by-step movement to the films. However, this solution while being the latest, shows the inconvenience of determining deformations, often uncontrolled, on the films which in turn makes difficult to promote an accurate advancement and, at the same time, causes unacceptable damages on the films themselves. Moreover, the necessity of centering the trays in the packaging station entails many problems in the automatization of the process and in the flexibility of the apparatus.

OBJECT OF THE INVENTION

Therefore, it is an object of the invention to devise a packaging process and apparatus capable of in-line forming trays used for packaging and capable of ensuring to efficiently form and move the same by keeping at a minimum the quantity of wasted material. Specifically, it is an object of the invention to provide a packaging apparatus and process enabling to in-line form trays from a base plastic film and enabling to accurately move the base plastic film along the manufacturing line.

Moreover, it is an object of invention to provide a packaging process and apparatus which are well adapted to any type of packaging process, for example of the vacuum type, or by the generation of a controlled atmosphere.

In addition, it is an ancillary object of the invention a process and apparatus easily enabling to adapt themselves to the manufacturing of different size trays.

A further ancillary object of the invention consists of providing a process and apparatus configured for adapting themselves to possible deformations of the base plastic film used for in-line forming trays during a packaging process.

Moreover, it is an additional object to offer a process and apparatus capable of using films having different widths without performing difficult operations for removing the lateral pulling means but by simply changing the forming and/or packaging stations.

Moreover, it is an object of the invention to do away with the pulling means active on the side edges of the films, such as chains and therefore by improving the access to the apparatus and therefore the maintainability of the same and by reducing, optionally eliminating, the waste of the used plastic material.

SUMMARY

Aspects of the invention are described in the following.

A 1st aspect provides an apparatus (1) for packaging a product (P) comprising:

- a forming station (2) configured for receiving a base film (3) and forming by it a precursor body (4) having a plurality of tray-shaped elements (5) adjacent to each other, wherein the forming station (2) comprises:
  - at least one upper portion (6), and
  - at least one lower portion (7),
  - the upper portion and lower portion being coupled to be movable with respect to each other between an open position of the forming station (2), wherein the upper portion (6) and lower portion (7) are spaced from each other and enable a longitudinal segment (3*a*) of the base film (3) to enter the forming station (2), and a closed position of the forming station (2), wherein the upper portion (6) and lower portion (7) are approached to each other for blocking said longitudinal segment (3*a*) of the base film (3) with reference to the forming station (2) and forming in such longitudinal segment (3*a*) one or more of said tray-shaped elements (5), a packaging station (8) configured for receiving said precursor body (4) and a closing film (9), the packaging station (8) being configured for fixing the closing film (9) to the precursor body (4) at least at an upper opening (5*a*) of a predetermined number of said tray-shaped elements (5) for forming packages (C) flanked to each other, the packaging station (8), comprising in turn:

a lower tool (10) comprising a predetermined number of seats (11), each configured for receiving at least one of said tray-shaped elements (5), and an upper tool (12) facing the lower tool (10) and configured for cooperating with the lower tool (10) for fixing at least a portion of said closing film (9) to one or more tray-shaped elements (5) placed in said seats (11), wherein the upper tool (12) and lower tool (10) are movable with respect to each other between an open condition of the packaging station (8), wherein the upper tool (12) and lower tool (10) are spaced from each other and enable to place one or more tray-shaped elements (5) in said seats (11) and to place said portion of the closing film (9) above one or more respective tray-shaped elements (5), and a closed condition of the packaging station (8), wherein the upper tool (12) and lower tool (10) are approached to each other for blocking the one or more tray-shaped elements (5) present in said seats (11) with respect to the packaging station (8) and fixing said closing film portion (9) to such one or more respective tray-shaped elements (5) present in said seats (11).

In a 2nd aspect according to the aspect 1, the apparatus comprises at least one movement device (13) configured for moving, along a predetermined advancement path (T) of said precursor body (4), at least one of said forming (2) and packaging stations (8).

In a 3rd aspect according to anyone of the preceding aspects, the apparatus comprises a control unit (14) active on said forming (2) and packaging stations (8) and also on the movement device (13), and configured for:

commanding a movement of the forming station (2) between the respective open position and the respective closed position, commanding a movement of the packaging station (8) between the respective open condition and the respective closed condition.

In a 4th aspect according to the preceding aspect, the control unit is also configured for commanding the movement device (13) to apply a displacement to the forming station (2) along said predetermined advancement path (T) at least when the forming station (2) is in said closed position.

In a 5th aspect according to anyone of the preceding two aspects, the control unit is also configured for commanding the movement device (13) to apply a displacement to the packaging station (8) along said predetermined advancement path (T) at least when the packaging station (8) is in said closed condition.

In a 6th aspect according to anyone of the preceding three aspects, the control unit is also configured for coordinating the movement of the forming station (2) between the respective open position and the respective closed position, with the movement of the packaging station (8) between the respective open condition and the respective closed condition, and with said at least one displacement performed by the movement device (13) for conferring to the precursor body (4) or to at least one longitudinal portion of the precursor body, a step-by-step discontinuous movement along said predetermined advancement path (T).

In a 7th aspect according to anyone of the preceding five aspects, the movement device (13) is active both on the forming station (2) and the packaging station (8) and is configured for moving along said predetermined advancement path (T) said precursor body (4), both said forming (2) and packaging stations (8), and wherein the control unit (14) is configured for:

commanding the movement device (13) to apply a displacement of the forming station (2) along said predetermined advancement path (T) at least when the forming station (2) is in said closed position, commanding the movement device (13) to apply a displacement of the packaging station (8) along said predetermined advancement path (T) at least when the packaging station (8) is in said closed condition.

In an 8th aspect according to anyone of the preceding six aspects, said movement device (13) active on the forming station (2) is configured for:

moving the forming station (2) from a respective starting position, along a forward stroke along said predetermined advancement path (T), until it reaches a respective arrival position, and moving the forming station (2) from the respective arrival position, for a return stroke opposite to the forward stroke, until it reaches a new starting position.

In a 9th aspect according to the preceding aspect, the control unit (14) is also configured for:

commanding the forming station (2) to be placed in said respective closed position and forming said tray-shaped elements (5) during said forward stroke, commanding the forming station (2) to be placed in said open position during said return stroke.

In a 10th aspect according to anyone of the preceding three aspects, said movement device (13) active on the packaging station (8), is configured for:

moving the packaging station (8) from a respective starting position, along a forward stroke along said predetermined advancement path (T), until it reaches a respective arrival position, and moving the packaging station (8) from the respective arrival position, for a return stroke opposite to the forward stroke, until it returns to a new starting position.

In an 11th aspect according to the preceding aspect, the control unit (14) is also configured for commanding the packaging station (8) to be placed in said respective closed condition, and fixing said closing film (9) portion to one or more respective tray-shaped elements (5) present in said seats (11), during said forward stroke, and commanding the packaging station (8) to be placed in said open position during said return stroke.

In a 12th aspect according to anyone of the preceding aspects, the apparatus is configured so that the precursor body or at least a longitudinal portion of the precursor body (4) is conferred a movement along said predetermined advancement path (T) exclusively by an action of the forming and packaging stations themselves during the respective forward strokes (at which the forming and packaging stations grippingly act on the base film and on the precursor body, and move along the predetermined advancement path (T)).

For example, the longitudinal portion of the precursor body (4)—to which the movement along said predetermined advancement path (T) is conferred exclusively by the forming station and packaging stations themselves during the respective forward strokes—extends between the forming station and packaging station when the forming station and packaging station are going to start the respective forward strokes along said predetermined advancement path (T).

In a preferred embodiment, the apparatus is also configured so that the movement of the base film up to the forming station is exclusively conferred by the forming station and packaging station themselves during the respective forward strokes.

In a 13th aspect according to anyone of the preceding aspects, said movement device (13) comprises:

a first actuator member (15) active on the forming station (2), and configured for reciprocally moving the forming station (2) along said forward and return strokes of the forming station (2), and a second actuator member (16), independent from the first actuator member (15), active on the packaging station (8) and configured for reciprocally moving the packaging station (8) along said forward and return strokes of the packaging station (8).

In a 14th aspect according to anyone of the preceding aspects from 1 to 12, said movement device (13) comprises a slide (17) arranged for supporting the forming station (2) and packaging station (8), a first actuator member (15) active on the slide (17) and configured for reciprocally moving such slide (17) and therefore the forming station (2) and packaging station (8) along a same common forward stroke and a same common return stroke, and a second actuator member (16), supported by said slide (17) and active on at least one of said forming station (2) and packaging station (8), said second actuator member (16) being configured for changing a relative distance between the stations themselves.

In a 15th aspect according to anyone of the preceding two aspects, the control unit (14) is connected to said first and second actuator members (15, 16) and is configured for applying to the forward stroke of the forming station (2) a first displacement value and for imposing to the forward stroke of the packaging station (8) a second displacement value different from the first displacement value.

In a 16th aspect according to the preceding aspect, the first and second displacement values are both preset values.

In a 17th aspect according to the aspect 15, the first displacement value is preset, while the second displacement value is calculated by the control unit (14) as a function of the first displacement value.

In an 18th aspect according to the aspect 15, the first displacement value is preset, while the second displacement value is calculated by the control unit (14) as a function of the first displacement value, and a deformation information regarding a longitudinal deformation of the precursor body (4) between the forming station (2) and packaging station (8).

In a 19th aspect according to anyone of the aspects from 13 to 18, the control unit (14) is connected to said first and second actuator members (15, 16) and is configured for imposing to the return stroke of the forming station 2, a third displacement value, and imposing to the return stroke of the packaging station (8), a fourth displacement value equal to or different from the third displacement value.

In a 20th aspect according to the aspect 19, said third and fourth displacement values are both preset values.

In a 21st aspect according to the aspect 19, said third and fourth displacement values are preset and respectively equal to the first and second displacement values.

In a 22nd aspect according to the aspect 19, the third displacement value is preset, and preferably equal to the first displacement value, while the fourth displacement value is calculated by the control unit (14) as a function of the first displacement value or third displacement value.

In a 23rd aspect according to the aspect 19, the third displacement value is preset, and preferably equal to the first displacement value, while the fourth displacement value is calculated by the control unit (14) as a function of the first displacement value or third displacement value, and a deformation information regarding a longitudinal deformation of the precursor body (4) between the forming station (2) and packaging station (8).

In a 24th aspect according to anyone of the preceding aspects, the control unit (14) is configured for synchronizing the/a forward stroke of the forming station (2) with the/a forward stroke of the packaging station (8), and for synchronizing the/a return stroke of the forming station (2) with the/a return stroke of the packaging station (8).

In a 25th aspect according to anyone of the preceding aspects, the apparatus has a sensor member (18) active in detection on said precursor body (4) and capable of detecting at least one between (or both):

one or more references (19) made on said precursor body (4), one or more of said tray-shaped elements (5) present in said precursor body (4).

In a 26th aspect according to the preceding aspect, said sensor member (18) is configured for emitting and delivering to the control unit (14) an activation signal upon detecting one or more of said references (19) or one or more of said tray-shaped elements (5), respectively.

In a 27th aspect according to the preceding aspect, the control unit (14) is connected to the sensor member (18) and is configured for:

receiving said activation signal, determining from said activation signal, a position of the tray-shaped elements (5) to be closed, moving the packaging station (8) from the respective arrival position, for a return stroke opposite to the forward stroke, until it returns to the new starting position wherein the packaging station is centered with respect to the determined position of the tray-shaped elements (5) to be closed.

In a 28th aspect according to anyone of the preceding aspects, the apparatus comprises at least one stop group (21) configured for acting on said base film (3).

In a 29th aspect according to anyone of the preceding aspects, the apparatus comprises at least one stop group (21) configured for acting on the precursor body (4) formed by the forming station (2).

In a 30th aspect according to anyone of the preceding aspects, the apparatus comprises at least one stop group (21) configured for acting on said packages formed by the packaging station (8).

In a 31st aspect according to anyone of the preceding three aspects, each stop group (21) is further configured for being placed between at least one release condition, wherein it enables the precursor body (4) or said packages respectively to move along the advancement path (T), and a gripping condition, wherein the stop group (21) acts on the precursor body (4) or on said packages respectively, for preventing a movement along the advancement path (T).

In a 32nd aspect according to the preceding aspect, said control unit (14) is configured for commanding the stop group (21) to be placed and remain in said closed condition when said forming station (2) is in said open position and/or when said packaging station (8) is in said open condition.

In a 33rd aspect according to anyone of the preceding five aspects, said/each stop group (21) comprises:

a first stop group (21*a*) active on said precursor body (4) and operating in an area comprised between said forming station (2) and said packaging station (8), or active on said base film (3) and operating upstream said forming station (2), and a second stop group (21*b*) active on said precursor body (4) and operating in an area comprised between said forming station (2) and said packaging station (8), or active on said packages downstream the packaging station (8), said control unit (14) being configured for commanding the first and second stop groups (21*a*, 21*b*) to be placed substantially simultaneously and to remain both in said gripping condition when said forming station (2) is in said open position and/or when said packaging station (8) is in said open condition.

In a 34th aspect according to anyone of the preceding aspects, the apparatus comprises a marking member (22) capable of making on the base film (3) or precursor body (4) at least one reference notch, optionally wherein said marking member (22) comprises a punch or knife which is configured for acting on the base film (3) or precursor body (4) by making said reference notch.

In a 35th aspect according to anyone of the preceding aspects, the apparatus comprises a cutting unit (23) configured for transversally and/or longitudinally separating said packages (C) into units distinct from each other, each comprising one or more tray elements (5), wherein the cutting unit (23) is configured for cuttingly acting on the precursor body and/or the closing film applied to it.

In a 36th aspect according to anyone of the preceding aspects, the apparatus comprises a piercing unit (40) provided with a piercing tool (41) capable of moving from a rest condition, in which is away from the precursor body and to an operative condition wherein the piercing tool acts on said precursor body by making at least one through opening (42) on a wall, optionally on a lateral wall of a respective tray-shaped element.

In a 37th aspect according to the aspect 36, the first stop group (21*a*) comprises the piercing unit which, under the gripping condition of the stop group (21*a*), is configured for acting on the precursor body (4) by making said at least one of said through openings.

In a 38th aspect according to the aspect 34, the first stop group (21*a*) comprises the marking member (22) which, under the gripping condition of the first stop group (21*a*), is configured for acting on the base film (3) or precursor body (4) by making said reference notch.

In a 39th aspect according to the aspect 35, the second stop group (21*b*) comprises the cutting unit (23) configured for cuttingly acting on the precursor body (4) and/or closing film (9) applied to it, when the second stop group (21*b*) is in said gripping condition.

In a 40th aspect according to anyone of the preceding aspects, said forming station (2), said packaging station (8) and said movement group (13) are supported by a fixed frame (24) on which the advancement path (T) of the base film (3) and precursor body (4) is defined.

In a 41st aspect according to anyone of the preceding aspects, the apparatus (1) further comprises at least one supplying station (25), optionally comprising a supplying roll of said base film (3), which exhibits a width (L1) having an extension equal to or different for no more than 1 cm with respect to a width (L2) of the processing area (27) of the forming station (2); the above mentioned widths are measured parallelly to each other and normal to the advancement direction (A) of the base film (3) along the predetermined advancement path (T).

In a 42nd aspect according to anyone of the preceding aspects, the packaging station (8) comprises at least one welding rod arranged to heat fix the closing film (9) to said one or more tray-shaped elements of the precursor body (4), and wherein the welding rod exhibits a maximum width substantially equal to or slightly different—optionally from 1 to 5 mm greater or from 1 to 5 mm smaller—from the maximum transversal width of the precursor body (4) and closing film (9); the above mentioned widths are all measured parallelly to each other and normal to the advancement direction (A) of the base film (4) along the predetermined advancement path (T).

In a 43rd aspect according to anyone of the preceding aspects, said sensor member (18) is integrally supported by the fixed frame (24) of packaging station (8).

In a 44th aspect according to anyone of the preceding aspects, at least one memory (28) is connected to the control unit (14) and is arranged to store a plurality of length values to be imposed to the forward and return strokes of the forming station (2).

In a 45th aspect according to anyone of the preceding aspects, at least one memory (28) is connected to the control unit (14) and is arranged for storing a plurality of length values to be applied to the forward and return strokes of the packaging station (8).

In a 46th aspect according to anyone of the preceding aspects, the control unit (14) is arranged to:

receive an information regarding the type of tray-shaped elements (5) formable by the forming station (2), and select by said memory (28), based on said information, the value to impose to one, two, three, four, five or all of the following:

the forward stroke of the forming station (2), the return stroke of the forming station (2), the forward and return strokes of the forming station (2), the forward stroke of the packaging station (8), the return stroke of the packaging station (8), the forward and return strokes of the packaging station (8).

In a 47th aspect according to the preceding aspect, said information is received by an input signal from a user interface connected to the control unit (14), or from a sensor active on the forming station (2) and capable of identifying the type of tray-shaped elements (5) formable by the forming station (2), or from a sensor active on the precursor body (4) and capable of identifying the type of the tray-shaped elements (5) formed by the forming station (2).

In a 48th aspect according to anyone of the preceding aspects, said packaging station (8) is placed at a predetermined distance from the forming station (2), said forward stroke of said forming (2) and/or packaging stations (8) having a length which is a submultiple of said predetermined distance.

In a 49th aspect according to anyone of the preceding aspects, said packaging station (8) is placed at a predetermined distance from the forming station (2), said forward stroke of said forming (2) and packaging station (8) having a length which is a submultiple of said predetermined distance.

In a 50th aspect according to anyone of the preceding aspects, said control unit (14) is configured for commanding said first and/or said second actuator members (15, 16) and for varying said predetermined distance as a function of the forward stroke to be imposed to said forming (2) and packaging stations (8).

A 51st aspect refers to a packaging process using the apparatus (1) of anyone of the preceding aspects.

In a 52nd according to the preceding aspects, the process comprising the following steps:

forming, in the forming station (2), a predetermined number of tray-shaped elements (5) at a longitudinal length of a base film (3), by making a continuous precursor body (4) provided with tray-shaped elements (5) adjacent to each other, placing one or more products to be packaged in said tray-shaped elements (5), fixing, in the packaging station (8), a longitudinal length of a closing film (9) to a predetermined number of tray-shaped elements (5) of the precursor body (4) present in the packaging station (8), conferring at least to the base film (3) and precursor body (4) a step-by-step movement along a predetermined advancement path (T).

In a 53rd aspect according to the preceding aspect, the step of conferring to the base film (3) and precursor body (4) a step-by-step movement provides to:

move said forming station (2) along the advancement path (T) along a forward stroke from a starting point until it reaches an arrival point, during said step of moving the forming station (2) along the forward stroke, such station remaining in the respective closed position and forming in the base film (3) the predetermined number of tray-shaped elements (5).

In a 54th aspect according to anyone of the two preceding aspects, the step of conferring to the base film (3) and precursor body (4) a step-by-step movement provides to:

move the packaging station (8) along the advancement path (T) along a forward stroke from a starting point until it reaches an arrival point, during said step of moving the packaging station (8) along the forward stroke, such station remaining in the respective closed condition and fixing said longitudinal segment of the closing film (9) to the predetermined number of tray-shaped elements (5) present in the packaging station (8).

In a 55th aspect according to anyone of the preceding three aspects, the step of conferring to the base film (3) and the precursor body (4) a step-by-step movement provides to:

move said forming station (2) along a return stroke until it reaches a respective starting point, during said step of moving the forming station (2) along the return stroke such station remaining in the respective open position.

In a 56th aspect according to anyone of the preceding four aspects, the step of conferring to the base film (3) and the precursor body (4) a step-by-step movement provides to:

move the packaging station (8) along a return stroke until it reaches a respective starting point or a new arrival point, during said step of moving the packaging station (8) along the return stroke, such station remaining in the respective closed condition.

In a 57th aspect according to anyone of the preceding five aspects, the step of conferring to the base film (3) and the precursor body (4) a step-by-step movement further comprises a step of stopping the precursor body (4) and/or the base film (3) obtained by holding the base film (3) and/or precursor body (4) by a stop group (21) active on the base film and/or precursor body during said return strokes of the forming station and packaging station (8).

In a 58th aspect according to anyone of the preceding six aspects, the step of conferring to the base film (3) and the precursor body (4) a step-by-step movement further provides a step of stopping the precursor body (4) and base film (3) obtained by holding the base film (3) and precursor body (4) by a stop group (21) active on the base film and precursor body during said return strokes of the forming station and packaging station (8).

In a 59th aspect according to anyone of the aspects from 51 to 58, during the step of forming the tray-shaped elements (5), the forming station (2) is in a closed position, in order to block a longitudinal segment of the base film (3) with respect to the forming station.

In a 60th aspect according to anyone of the aspects from 51 to 59, during the step of fixing said longitudinal segment of the closing film (9) to the predetermined number of the tray-shaped elements (5), the packaging station (8) is in a closed condition in order to block a segment of the precursor body (4) and closing film (9) with respect to the packaging station (8).

In a 61st aspect according to anyone of the aspects from 51 to 60, the precursor body (4) or at least one longitudinal portion of the same is moved along the advancement path (T) exclusively by the movement applied to it by the forming station (2) and packaging station (8).

The longitudinal portion of the precursor body (4) is moved along said predetermined advancement path (T) exclusively by the forming station and packaging station during respective forward strokes of the stations themselves. The longitudinal portion of the precursor body (4)—to which the movement along said predetermine advancement path (T) is exclusively applied by the forming and packaging stations themselves during the respective forward strokes—extends at least between the forming station and packaging station when the forming station and packaging station are going to start the respective forward strokes along said predetermined advancement path (T).

In a further variant, the movement of the base film up to the forming station is applied exclusively by the forming station and packaging station themselves during the respective forward strokes.

In a 62nd aspect according to anyone of the preceding aspects, the packaging apparatus and process do not provide the use of advancement means—except for the forming station and packaging station—which are active on the longitudinal edges of the precursor body.

In a 63rd aspect according to anyone of the aspects from 51 to 62, the forming station defines a closing perimeter of an area wherein said base film (3) is processed, and wherein the base film (3) is supplied to the forming station (2) by a supplying station (25) and exhibits a width such it does not project for no more than 10 mm from the closing perimeter of the forming station (2).

In a 64th aspect according to anyone of the aspects from 51 to 63, wherein said closing film (9), for example from a respective film supplying roll, exhibits a width which does not differ for no more than 10 mm from a width of the same precursor body (4).

In a 65th aspect according to anyone of the aspects from 51 to 64, it is provided to determine the forward stroke to be applied to said forming station (2) and/or said packaging station (8) based on the type of tray-shaped elements (5) to be formed.

In a 66th aspect according to anyone of the aspects from 51 to 65, it is provided to determine the forward stroke to be applied to said forming station (2) and said packaging station (8) based on the type of tray-shaped elements (5) to be formed.

In a 67th aspect according to anyone of the aspects from 51 to 66, it is provided a step of adjusting the distance between the forming station (2) and packaging station (8) as a multiple of said forward stroke of said forming station (2).

In a 68th aspect according to anyone of the aspects from 51 to 67, it is provided a step of adjusting the distance between the forming station (2) and packaging station (8) as a multiple of said forward stroke of the packaging station (8).

In a 69th aspect according to anyone of the aspects from 51 to 68, the process provides, during the forward stroke thereof (besides sealing the closing film to the tray), that the packaging station provides to form a vacuum (or a low pressure condition having a predetermined level) inside the packaging chamber so that the closing film is attached to the precursor body and, particularly, to each respective tray-shaped element by sealing the flange of each tray and by closely conforming to the outline of the product and possibly to the tray inner part not occupied by a product.

In a 70th aspect according to anyone of the aspects from 51 to 69, the process provides that the packaging station, during the forward stroke (besides sealing the closing film to the tray) forms a controlled atmosphere inside the packaging chamber and therefore inside each tray.

In a 71st aspect according to anyone of the aspects from 51 to 70, the piercing unit (40) operates in the packaging station and is controlled by the control unit in order to pierce the lateral wall of the tray or trays during the forward stroke.

In a 72nd aspect according to the preceding aspect, the piercing tool of the unit (40) is tubular and connected to the vacuum group and/or controlled atmosphere forming group and is used—always under the control exerted by the control unit—for suctioning air (by defining a vacuum in the packaging chamber) or for blowing air under controlled atmosphere.

BRIEF DESCRIPTION OF THE DRAWINGS

Some embodiments and some aspects of the invention will be described in the following with reference to the attached drawings given only in an indicative and therefore non limiting way, wherein.

Figure 1:
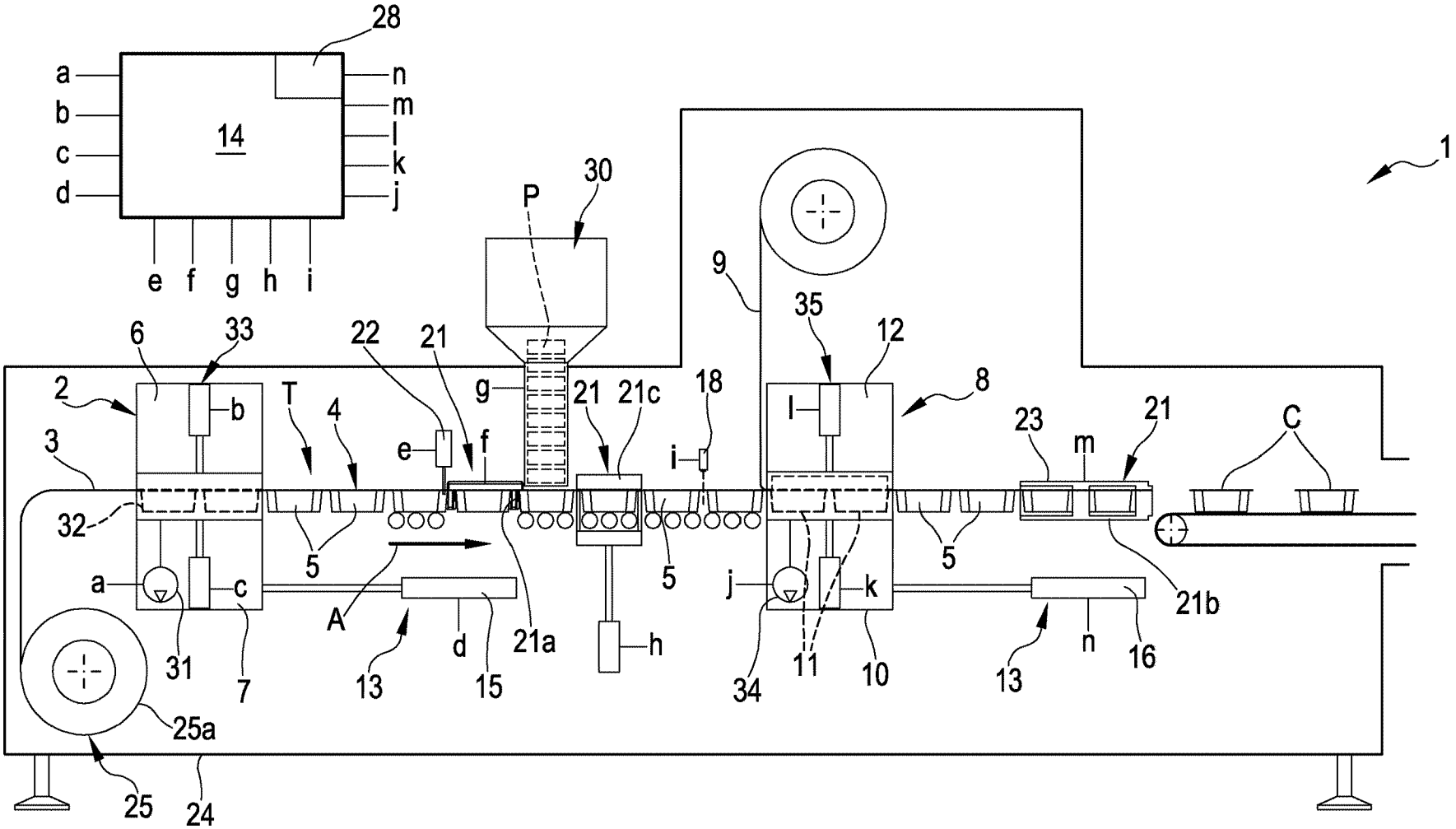
FIG. 1 is a schematic view of a first embodiment of an apparatus according to the present invention.
Figure 8:
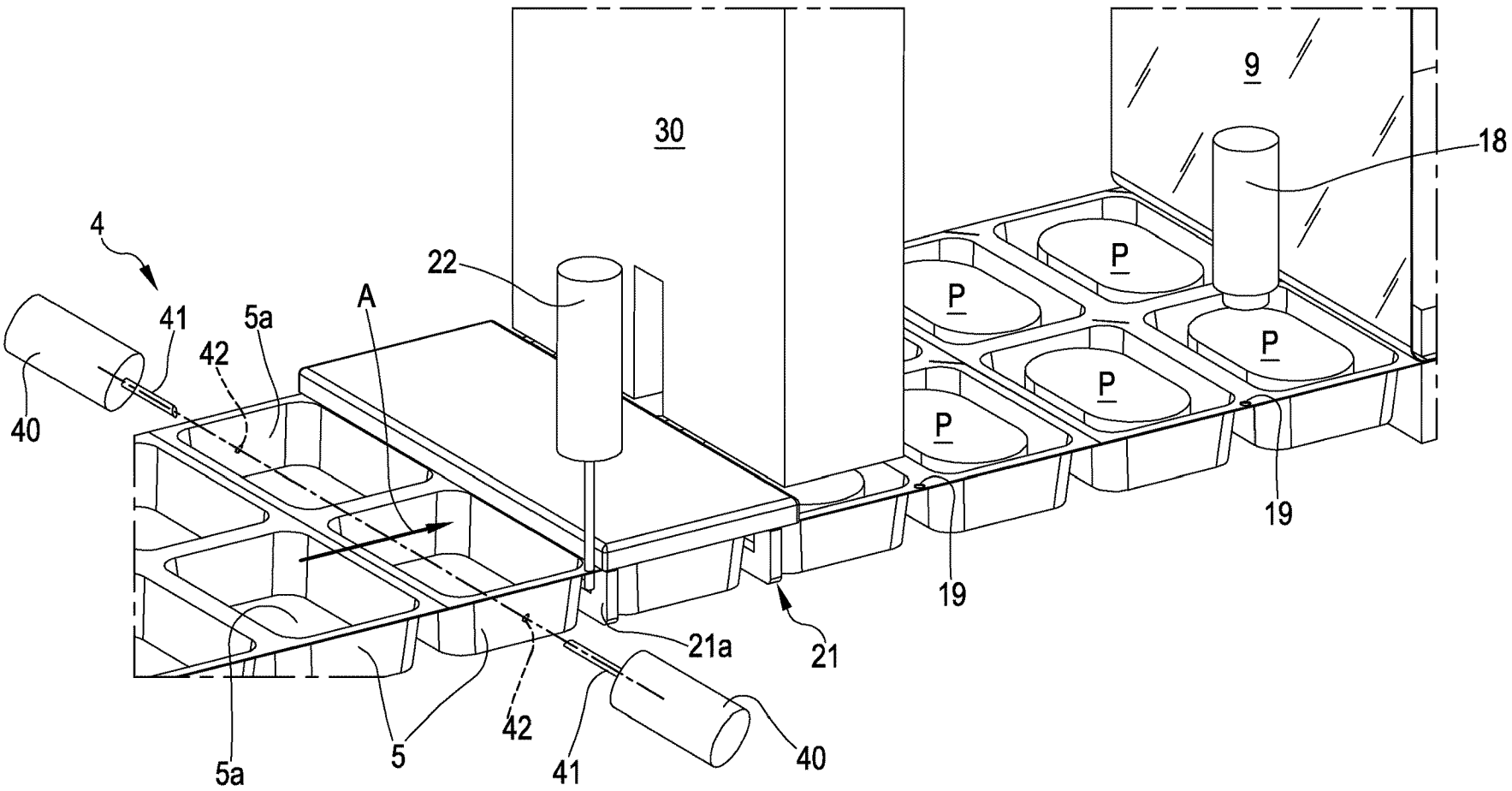
Figure 9:
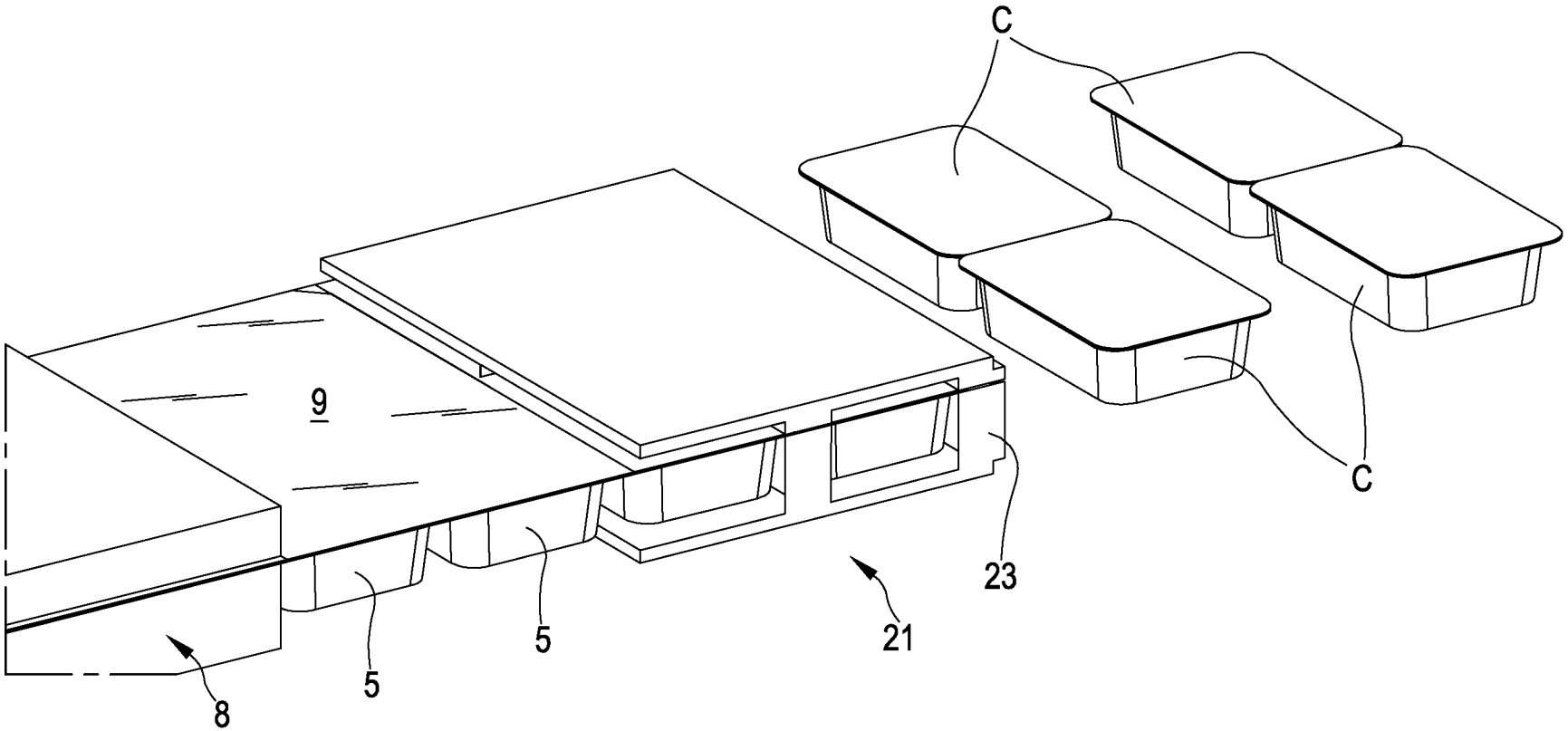
Figure 10:
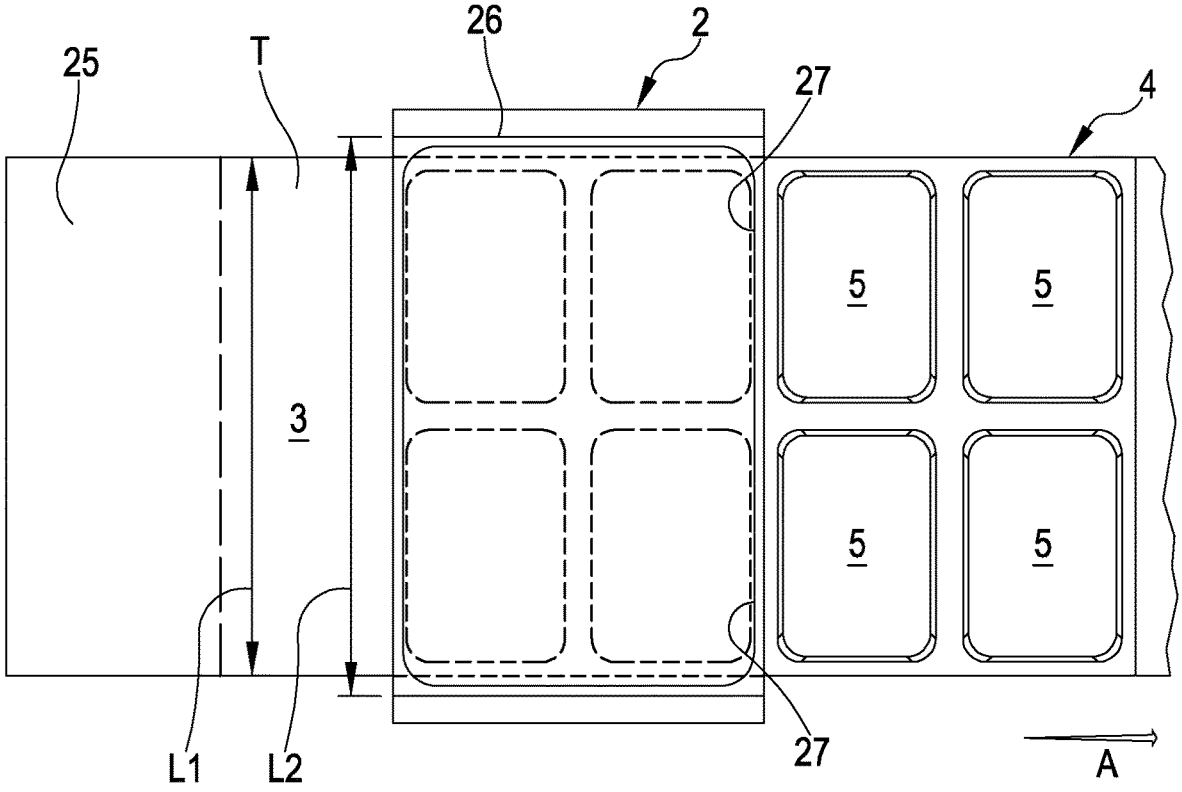
Figure 11:
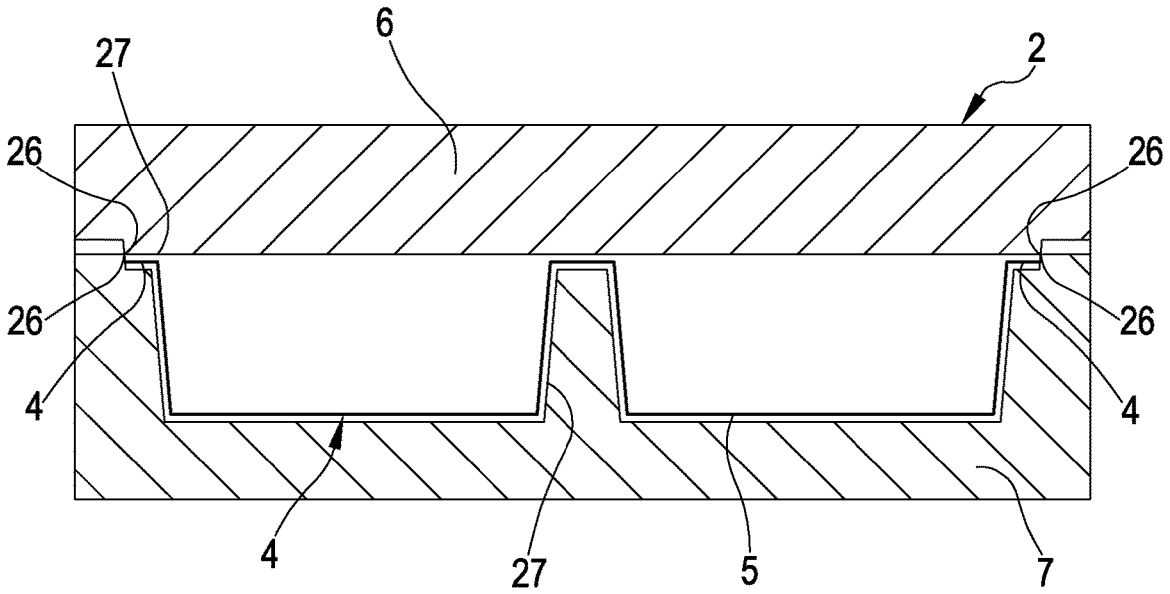
Figure 12:
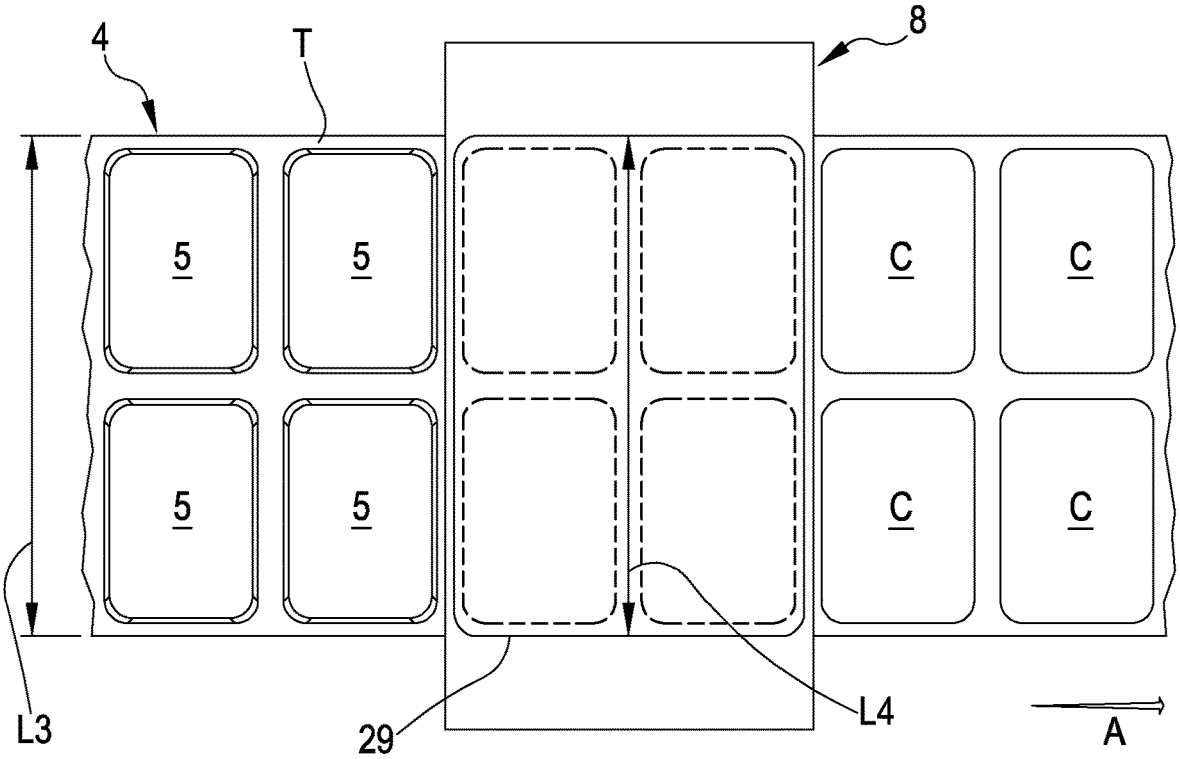
Figure 13:
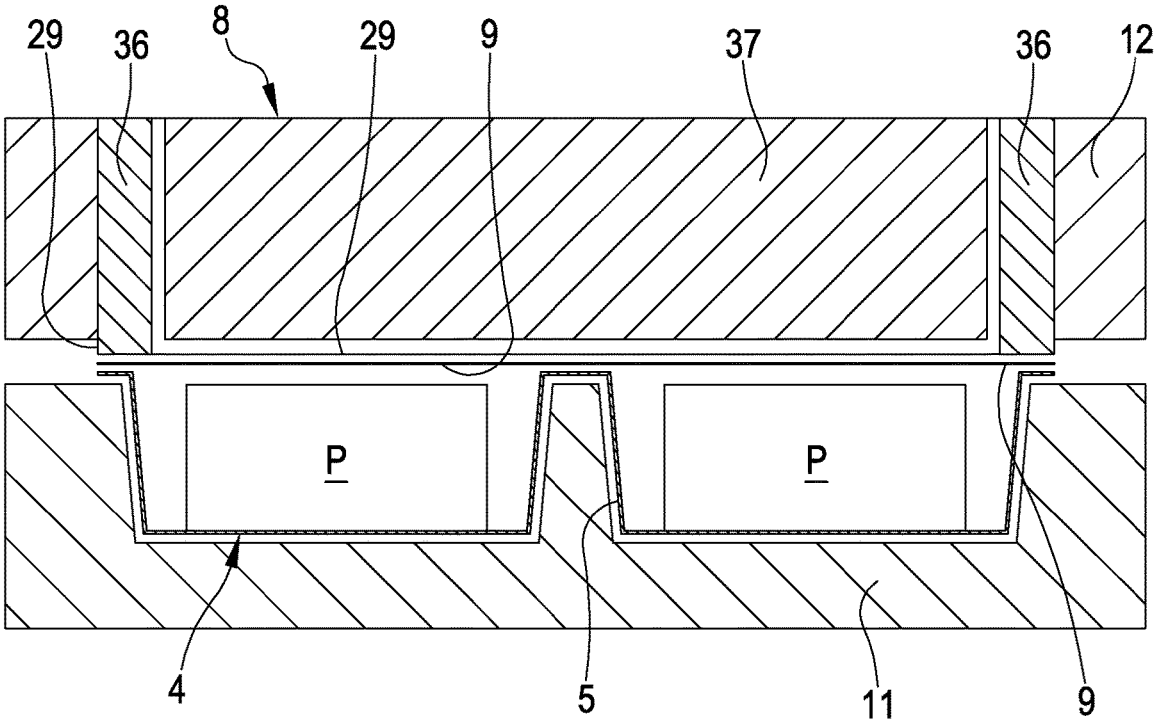

FIGS. from 2 to 7 are schematic views of the apparatus in FIG. 1 according to the present invention, arranged in different operative conditions;

FIGS. 8 and 9 are detailed perspective views of the apparatus according to the present invention;

FIG. 10 is a top view of a portion of the apparatus according to the present invention, wherein a forming station is visible;

FIG. 11 is a schematic cross-section view of the forming station;

FIG. 12 is a top view of a portion of the apparatus according to the present invention wherein a packaging station is visible;

FIG. 13 is a schematic cross-section view of the packaging station.

MATERIALS AND DEFINITIONS

The figures could illustrate the object of the invention by not-to-scale views; therefore, parts and components illustrated in the figures regarding the object of the invention could refer only to schematic views.

In the following description and claims, the terms upstream and downstream refer to an advancement direction of the base film and precursor body formed by such base film along an advancement path extending from a base film supplying station, through the forming station, to the packaging station and therefore to the station discharging the packaged trays.

With Tray it is intended both rigid and semi-rigid trays, obtainable by forming, for example thermoforming. The trays can comprise a support, for example substantially flat, or a structure comprising a base, a lateral wall perimetrally emerging from said base, and a flange radially emerging from the top of the lateral wall.

It is observed that when the envelope or envelopes comprise a tray, the trays are made of mono-layer and multi-layer thermoplastic materials. Preferably, the tray is provided with a gas barrier property. Such term, as herein used, refers to a film or sheet of a material having an oxygen transmission rate less than 200 $cm^3/m^2$-day-bar, less than 150 $cm^3/m^2$-day-bar, less than 100 $cm^3/m^2$-day-bar when measured according to the standard ASTM D-3985 at 23° C. and 0% of relative humidity.

Instead, the term "product" means an article or a compound of articles of any type. For example, the product can be a food type product and can be at a solid, liquid or gel state, in other words as two or more of the preferred aggregation states.

a) Materials Adapted for the Tray

Materials adapted for gas barrier mono-layer thermoplastic containers are for example polyesters, polyamides and the like. Preferably, the tray is made of a multi-layer material comprising at least one gas barrier layer and at least one heat sealable layer for enabling to seal the covering film to the tray surface. The gas barrier polymers which can be used for the gas barrier layer are PVDC, EVOH, polyamides, polyesters, and mixtures thereof. PVDC is any vinylidene chloride copolymer wherein any main amount of the copolymer comprises vinylidene chloride and a minor amount of the copolymer comprises one or more unsaturated monomers co-polymerizable with it, typically vinyl chloride and alkyl acrylates or methacrylates (for example methylacrilate or methacrylate) and mixtures thereof with different proportions. Generally, a barrier layer made of PVDC will contain plasticizers and/or stabilizers as it is known in the art.

The term EVOH, as herein used, includes saponified or hydrolyzed ethylene-vinylacetate copolymers and refers to ethylene/vinyl alcohol copolymers having a contents of co-monomers preferably consisting of a percentage between about 28 and about 48% mole, preferably between about 32 and about 44% mole of ethylene, and still more preferably, and a saponification value of at least 85%, preferably at least 90%.

The term polyamides means omo- and co- or ter-polymers. This term particularly comprises polyamides or aliphatic co-polyamides, for example polyamide 6, polyamide 11, polyamide 12, polyamide 66, polyamide 69, polyamide 610, polyamide 612, co-polyamide 6/9, co-polyamide 6/10, co-polyamide 6/12, co-polyamide 6/66, co-polyamide 6/69, aromatic and partially aromatic polyamides or co-polyamides, such as polyamide 61, polyamide 6I/6T, polyamide MXD6, polyamide MXD6/MXDI, and mixtures thereof.

The term polyesters refers to polymers obtained by a poly-condensation reaction of dicarboxylic acids with dihydroxylic alcohols. Suitable dicarboxylic acids are, for example, terephtalic acid, isophtalic acid, dicarboxylic 2,6-naphtelene acid and the like. Suitable dihydroxylic alcohols are for example ethylene glycol, diethylene glycol, 1,4-butanediole, 1,4-cyclohexanedimethanole and the like. Examples of useful polyesters comprise poly(ethylene terephthalate) and co-polyesters obtained by the reaction of one or more carboxylic acids with one or more dihydroxylic alcohols.

The thickness of the gas barrier layer is set in order to provide the tray with an oxygen transmission rate at 23° C. and 0% of relative humidity, less than 50, preferably less than 10 $cm^3/m^2 \cdot day \cdot atm$ when measured according to the standard ASTM D-3985.

Generally, the heat sealable layer will be selected among polyolefins, such as ethylene omo- or co-polymers, propylene omo- or co-polymers, ethylene/vinylacetate co-polymers, ionomers, and omo- or co-polyesters, for example PETG, a glycol modified polyethylene terephthalate. The term co-polymer, as herein used, indicates a polymer obtained by two or more kinds of monomers and includes terpolymers. The ethylene omo-polymers include high density polyethylene (HDPE) and low density polyethylene (LDPE). Ethylene co-polymers comprise ethylene/alpha-olefins copolymers and unsaturated ethylene/ester copolymers. The ethylene/alpha-olefin copolymers generally comprise ethylene copolymers and one or more co-monomers selected among alpha-olefins having from 3 to 20 carbon atoms, such as 1-butene, 1-pentene, 1-hexene, 1-octene, 4-methyl-1-pentene and the like.

The alpha-olefin/ethylene copolymers generally have a density in the range between about 0.86 and about 0.94 $g/cm^3$. Generally, the term "linear low density polyethylene (LLDPE)" comprises a group of ethylene/alpha-olefin copolymers falling in the density range between about 0.915 and about 0.94 $g/cm^3$, and particularly between about 0.915 and about 0.925 $g/cm^3$. Sometimes, the linear polyethylene in the density range between about 0.926 and about 0.94 $g/cm^3$ is known as linear medium density polyethylene (LMDPE). The ethylene/alpha-olefin copolymers of lower density are known as very low density polyethylene (VLDPE) and ultra-low density polyethylene (ULDPE). The ethylene/alpha-olefin copolymers can be obtained by heterogeneous or homogeneous polymerization processes.

Another useful ethylene copolymer is an unsaturated ethylene/ester copolymer, which is ethylene copolymer and one or more unsaturated ester monomers. Useful unsaturated esters comprise vinyl esters of aliphatic carboxylic acids, wherein the esters have from 4 to 12 carbon atoms, such as vinyl acetate, and alkyl esters of acrylic or methacrylic acid, wherein the esters have from 4 to 12 carbon atoms.

The ionomers are copolymers of an ethylene and an unsaturated mono-carboxylic acid, the carboxylic acid being neutralized by a metal ion, such as zinc or, preferably, sodium.

Useful propylene copolymers comprise propylene/ethylene copolymers which are propylene and ethylene copolymers, the majority of the weight percentage contents thereof being propylene and propylene/ethylene/butane terpolymers, which are propylene, ethylene and 1-butene copolymers.

Additional layers, such as adhesive layers for better adhering the gas barrier layer to the adjacent layers, can be present in the gas barrier material for the tray, and are preferably present based particularly on specific resins used for the gas barrier layer.

For a multilayer structure, a portion of it can be formed as a foam. For example, the multi-layer used for forming the tray can comprise (from the outer layer to the inner layer in contact with food) one or more structural layers, typically of a material as foamed polystyrene, foamed polyester or foamed polypropylene or a cast sheet for example of polypropylene, polystyrene, poly(vinyl chloride), polyester or paperboard; a gas barrier layer and a heat sealable layer. An easily-openable frangible layer can be placed adjacent the heat sealable layer for making easier to open the final package. Mixtures of low cohesive resistance polymers which can be used as a frangible layer are for example described in document WO99/54398. The total thickness of the tray will be typically, but non in a limiting way, up to 5.00 mm, preferably will be comprised between 0.04 and 3.00 mm, and more preferably between 0.05 and 1.50 mm, still more preferably between 0.15 and 1.00 mm).

b) Films Useable for Making a Vacuum Envelope or Package

To the trays a film is applied in order to make a package fluid-tightly housing the product. For making a vacuum package, the film applied to the tray is typically a flexible multi-layer material comprising at least one first outer heat sealable layer capable to be sealed to the inner surface of the tray, optionally a gas barrier layer and a second heat resistant outer layer. The polymers used in said multi-layer material should be easily formable since the film must be tight and softened by the contact with the heating plate before being placed on the product and tray. The film must also be placed on the product by following the shape thereof and the inner shape of the tray.

The heat sealable outer layer can comprise any polymer capable to be sealed to the inner surface of the tray. Polymers suitable for the heat sealable layer can be ethylene omo- and co-polymers, such as LDPE, ethylene/alpha-olefin copolymers, ethylene copolymers/acrylic acid, ethylene copolymers/methacrylic acids or ethylene copolymers/vinyl acetate, ionomers, and co-polyesters, for example PETG. The preferred materials to be used as heat sealable layer are LDPE, ethylene/alpha-olefin copolymers, for example LLDPE, ionomers, ethylene copolymers/vinyl acetate and mixtures thereof.

Based on the product to be packaged, the film can comprise a gas barrier layer. The gas barrier layer typically comprises oxygen barrier resins such as PVDC, EVOH, polyamides and mixtures of EVOH and polyamides. Typically, the thickness of the gas barrier layer is set in order to provide the film with an oxygen transmission rate at 23° C. and 0% relative humidity less than 10 $cm^3/m^2 \cdot day \cdot atm$, preferably less than 5 $cm^3/m^2 \cdot day \cdot atm$ when measured according to the standard ASTM D-3985.

Common polymers for the heat resistant outer layer are for example ethylene omo- or co-polymers, ethylene/cyclic olefin copolymers, such as ethylene/norbomene copolymers, propylene omo- or co-polymers, ionomers, polyesters, polyamides. Moreover, the film can comprise other layers such as adhesive layers, filling layers and the like for providing a thickness necessary to the film and for improving the mechanical properties thereof, such as the puncture resistance, abuse resistance, formability and the like.

The film is obtained by any adapted co-extrusion process, by means of a flat or circular port extrusion head, preferably by co-extrusion or by heat-blowing.

By using a packaging process called "skin-pack" or "VSP", called also vacuum process, the film is substantially non-oriented. Typically, the film or only one or more of the layers thereof is cross-linked for improving, for example, the film strength and/or heat resistance when the film is brought in contact with the heating plate during the vacuum skin-pack packaging process. The cross-linking can be obtained by using chemical additives or subjecting the film layers to an energy radiation treatment, such as a high energy electronic beam treatment, for promoting the cross-linking among the molecules of the irradiated material. Films adapted for this application have a thickness in the range from 50 to 200 micrometers, between 70 and 150 micrometers. Films suitable for being used as a film in a vacuum skin-pack packaging process are for example the films sold by Cryovac® under the trademarks TS201®, TH300®, VST™0250, VST™0280.

c) Films Useable for Making an Envelope or Package Wherein the Film is Applied as a Lid of a Tray (Tray Lidding) Inside which a Controlled Atmosphere or Air can Prevail.

In other applications, the film applied to the tray makes a package wherein the film substantially acts as a lid with respect to the tray top opening inside which a normal or modified atmosphere can prevail.

When the film is in fact used for forming a lid on a tray, the film material can be obtained by co-extrusion or lamination processes. The films for forming lids can have an asymmetrical or symmetrical structure and can be mono-layer or multilayer.

The multilayer films have at least 2, more frequently at least 5, more frequently at least 7 layers.

The overall thickness of the film can often vary from 3 to 100 micron, particularly from 5 to 50 micron, still more often from 10 to 30 micron.

Optionally, the films can be cross-linked. The cross-linking can be obtained by irradiating high energy electrons at a dosing level as it is known in the art. The above described lid films can be of thermoshrinkable resins or non thermoshrinkable resins. The thermoshrinkable films typically have a free thermoshrink value at 120° C. measured according to the standard ASTM D2732 in the range from 2 to 80%, more often from 5 to 60%, still more often from 10 to 40% both in the longitudinal and transversal directions.

The non thermoshrinkable resin films usually have free thermoshrink values at 120° C. measured according to the standard ASTM D2732 less, both in the longitudinal and transversal directions, than the above given values of the thermoshrinkable films.

The lid films usually comprise at least one heat sealable layer and a skin outer layer, which generally consists of heat resistant polymers or polyolefins.

Typically, the sealable layers comprise a heat sealable polyolefin in turn comprising a single polyolefin or a mixture of two or more polyolefins such as polyethylene or polypropylene or a mixture of such polyolefins. The sealable layer can be further provided with defogging properties by incorporating one or more defogging agents in the composition thereof or by covering or spraying one or more defogging additives on the surface of the sealable layer by means known in the art. The sealable layer can further comprise one or more plasticizers. The outer skin layer can comprise polyesters, polyamides or polyolefins. In some structures, a mixture of polyamides and polyesters can be advantageously used for making the outer skin layer. In some cases, the lid films comprise a barrier layer. The barrier property films have typically an OTR (evaluated at 23° C. and 0% of relative humidity according to the standard ASTM D-3985) less than 100 $cm^3/(m^2 \cdot day \cdot atm)$ and more often less than 80 $cm^3/(m^2 \cdot day \cdot atm)$. Generally, the barrier layer consists of a thermoplastic resin selected among a hydrolyzed or saponified product of vinyl ethylene-acetate copolymers (EVOH), an amorphous polyamide and a vinyl-vinylidene chloride and mixtures thereof. Some materials comprise a barrier layer EVOH, between two polyamide layers. The outer skin layer typically comprises polyesters, polyamides or polyolefins.

In some packaging applications, the lid films do not comprise any barrier layer. Such films usually comprise one or more polyolefins which are herein defined. Non-barrier films have typically an OTR (evaluated at 23° C. and 0% of relative humidity (RH) according to the standard ASTM D-3985) from 100 $cm^3/(m^2 \cdot day \cdot atm)$ to 10,000 $cm^3/(m^2 \cdot day \cdot atm)$, mote typically to 6,000 $cm^3/(m^2 \cdot day \cdot atm)$.

The lid films can be mono-layer. The standard composition of mono-layer films comprises polyesters as herein defined and the mixtures thereof of polyolefins are herein defined and mixtures thereof.

In all the film layers herein described, the polymeric components can contain suitable amounts of additives. Some of these additives are preferably included in the outer layers or in one of the outer layers, while other additives are preferably added only to the inner layers. These additives comprise anti-slip agents and anti-blocking agents (such as talc, waxes, silica, and the like), antioxidants, stabilizing agents, plasticizers, fillers, pigments, and dyes, cross-linking inhibitors, cross-linking enhancers, ultraviolet absorbers, odor absorbers, oxygen scavengers, bactericides, antistatic agent, or defogging compositions, and other possible additives known to the persons skilled in the film packaging technology.

DETAILED DESCRIPTION

Apparatus for Packaging a Product

Reference 1 generally indicates an apparatus for packaging a product P. As it is for example visible in FIGS. from 1 to 7, the apparatus 1 comprises a fixed frame 24 configured for enabling to abut on the ground the apparatus 1 and for engaging different components of the same, which will be better described in the following. De facto, the fixed frame 24 stably supports all the components of the apparatus 1 and enables to define a predetermined advancement path T of the products P.

As it is visible in FIGS. from 1 to 7, the apparatus 1 comprises at least one supplying station 25 of at least one base film 3; the film 3 exhibits a sheet structure having a first and second prevalent development surfaces defining a length and width of the film and delimiting the thickness of the same.

The attached figures illustrate a non limiting embodiment of the invention wherein the supplying station 25 comprises a roll 25*a* of a base film 3; the roll 25*a* is configured for longitudinal unwinding the base film 3 along an advancement direction A and along the predetermined path T (FIG. 10).

As it is visible in the attached figures, the apparatus 1 comprises a forming station 2 supported by the fixed frame 24 and placed downstream the supplying station 25 with respect to the advancement direction A; specifically, the forming station 2 is placed immediately downstream the supplying station 25: the film exiting the station 25 directly enters the forming station 2. The forming station 2 is configured for receiving the base film 3 from the supplying station 25 and forming by it a precursor body 4 having one or more tray-shaped elements 5 adjacent to each other. The attached figures illustrate, in a non limiting way, an embodiment of the station 2 configured for defining, at each forming cycle, a plurality of shaped elements 5 (a number of elements comprised between 2 and 8, for example). However, it is not excluded the possibility of using a forming station 2 configured for defining, at each forming cycle, a single tray element 5, for generating in this way a precursor body 4 with shaped elements 5 aligned on a single line. In the same way, it is possible to provide a forming station capable of forming a number of shaped elements greater than 8 at each forming cycle. The forming station 2 is substantially formed by at least one upper station 6 and at least one lower station 7 coupled to and relatively movable from each other between an open position (FIGS. 5 and 6) and a closed position (FIGS. from 1 to 4 and 7). In the open position, the upper portion 6 and lower portion 7 are spaced from each other and enable a longitudinal segment 3*a* of the base film 3 to enter the forming station 2; in the closed position of the forming station 2, the apparatus 6 and lower portion 7 are approached to each other for blocking the longitudinal segment 3*a* of the base film 3 with respect to the forming station 2 and for forming in such longitudinal segment 3*a*, one or more of said tray-shaped elements 5.

The forming station 2 can, for example, comprise a vacuum forming mould wherein the lower portion 7 comprises one or more recesses 32 having the shape of elements 5. The upper portion 6 of forming station 2 is configured for cooperating with the lower portion 7 for defining a tightly closed mould; in this case, the shape of elements 5 is only defined on the lower portion 7. Referring again to the case wherein the forming station operates for vacuum forming, the lower portion 7 comprises one or more channels configured for having a fluid communication between the forming recesses 32 and one or more vacuum pumps 31: actuating the pump 31 enables to adhere the base film 3 to the recesses 32 and therefore to form said precursor body with one or more shaped elements 5. Using the same mould configuration (the lower portion 7 supports one or more recesses 32 while the upper portion 6 defines only a closing element), it is possible to provide the upper portion 6 with a thrusting pump enabling to adhere the base film 3 to the shape of the lower portion 7 (this arrangement is not illustrated in the attached figures).

In a further embodiment of the forming station 2 illustrated in FIG. 11, the same can comprise a die-punch mould; in this case, the die is provided with one or more cavities 32 adapted to receive an outer surface of the precursor body, while the punch exhibits one or more projections counter-shaped to the recesses 32 of the die, adapted to thrust and deform the base film 3 inside the die in order to shape the precursor body 4 with one or more tray-shaped elements 5 (the number of the shaped elements depends on the number of recesses and projections of the mould).

As a further alternative, the forming station 2 can combine the kinds of the above described mould; particularly, the forming station 2 can comprise a die-punch mould comprising also a pump for forming the vacuum and/or a thrusting pump.

As it is visible for example in FIGS. from 1 to 7, the forming station 2 comprises an actuating system 33 configured for arranging the lower and upper portions in the open and closed positions. In a non limiting way, the actuating system 33 can comprise an actuator, for example a hydraulic or pneumatic actuator, configured for engaging both the portions 6, 7 and moving them for approaching and distancing them from each other for defining the closed position and open position, respectively. The attached figures illustrate, in a non limiting way, an arrangement wherein the actuating system 33 comprises two independent actuators acting respectively on the lower portion 7 and upper portion 6; in such arrangement, the independent actuators are engaged, from one side, to the frame 24, while, from the other side, are engaged to the respective portion 6, 7. Each portion 6, 7 is therefore movable with respect to the fixed frame 24 in order to help the longitudinal segment 3*a* of the base film 3 enter the forming station 2.

As it is visible in FIGS. 10 and 11, for example, the base film 3 exhibits a maximum width L1 equal or almost equal to a width L2 of the forming station 2: both said widths being measured parallelly to each other and normal to an advancement direction A of the base film along the predetermined advancement path T. Specifically, the forming station 2 comprises a closing perimeter 26 delimiting a processing area 27 of the base film 3, inside which this latter is formed for exhibiting said tray-shaped elements 5: the processing area defines the area of the forming station in contact with the film and adapted to form the lateral wall, the bottom and flange of each tray element. By the invention, and particularly by the pulling action applied by the forming station, the processing area 27 exhibits—according to an optional aspect of the invention—a width L2 equal to or slightly different (larger or smaller) from the one (in other words L1) of the base film. In other words, the closing perimeter 26 delimiting the processing area exhibits a maximum transversal width L2, measured normal to the advancement direction A of the base film 3 along the predetermined advancement path T, substantially equal to the width L1 of the base film (the difference between L1 and L2 can be from 0 mm to 1 cm, for example); in the example illustrated in FIG. 10, the width L2 is even slightly greater than the maximum width L1 of said base film 3, in other words the maximum width L1 of the base film 3 is not greater than the maximum width of the processing area 27 of the forming station 2. The above cited widths are all measured parallelly to each other and normal to the advancement direction A of the base film 3 along the predetermined advancement path T. Due to what has been described, it is possible to minimize the material necessary for forming the precursor body.

As it is again visible in FIGS. from 1 to 7, the apparatus 1 comprises a station supplying the products P, preferably engaged with (supported by) the fixed frame 24, placed downstream the forming station 2 with respect to the advancement direction A of the base film. De facto, the supplying station 30 is configured for inserting into the tray-shaped elements 5 one or more products P. Alternatively, the products can be manually loaded without any supplying stations.

The apparatus 1, downstream the supplying station 30 with respect to the advancement direction A of the base film 3, comprises a packaging station 8 configured for receiving the precursor body 4 and a closing film 9, for example from a source, such as a roll of said closing film 9; particularly, the supplying station 30 is interposed between the forming station 2 and packaging station 8 which, therefore, are placed at a predetermined minimum distance from each other along the advancement direction A of the precursor body 4; such distance is also dependent on and a multiple of the longitudinal extension, measured along the advancement direction A, of the processing area 27 of the forming station 2, in other words the distance longitudinally measured between a tray element and the following one (still referring to the advancement direction A).

The packaging station 8 is configured for fixing the closing film 9 to the precursor body 4 at least at an upper opening 5*a* of a predetermined number of tray-shaped elements 5 in order to form packages C approached to each other. De facto, the packaging station 8 is mainly dedicated to stably attach the film 9 (both as a continuous film or single sheets separated from each other) to the precursor body 4 and particularly to the tray-shaped element 5. To this end, the packaging station 8 provides a lower tool 10 defining a predetermined number of seats 11 each destined to receive at least one tray-shaped element 5. The packaging station 8 provides also an upper tool 11 facing the lower tool 10 and configured for cooperating with this latter in order to define a packaging chamber. The lower tool 12 preferably comprises a welding structure arranged to act on a band of the film 9 overlapping the flange of the respective element 5. The welding structure, for example comprising one or more welding bars 36, operates perimetrally to an insert 37 (see FIG. 13, for example) and is actuated and moved with respect to the lower tool 10 so that, when the packaging station 8 is in a closed condition, the heating surface of the welding structure acts on the film portion 9 overlapping an upper flange of the tray-shaped element 5 for thermosealing the film 9 to the flange. Optionally, the insert 37 of insulating material and/or at a suitably controlled temperature, exhibits a respective lower surface configured during the use to be placed above the film 9 and possibly contacting the film 9 itself when there is the requirement of applying to this latter (or better to a portion of this latter radially inside with respect to the surface of the welding structure) a determined heat level. As the case requires, the insert 37 can also operate as a body retaining the film 9 (in case the film is provided to the packaging station as single precut films, for example) and in this case, is provided with gripping means comprising, for example, a plurality of holes present on the lower surface of the insert and connected to a suctioning system for example managed by a control unit 14 which will be better described in the following.

In any case, by the cooperation of the lower tool 10 and upper tool 12, the portion of the film 9 is held just on the respective element 5 for therefore enabling to heat-couple each film sheet or film portion to the flange of the tray-shaped elements 5.

Moreover, as per se known, the packaging station 8 can be connected to a suctioning group 34 (schematically illustrated in FIG. from 1 to 7) capable of generating an at least partial vacuum condition in the packaging chamber and/or to a controlled atmosphere generating group (not illustrated in the attached figures), capable of injecting into the packaging chamber a gas or a mixture of gas having a controlled composition and different from the atmosphere.

Figure 5:
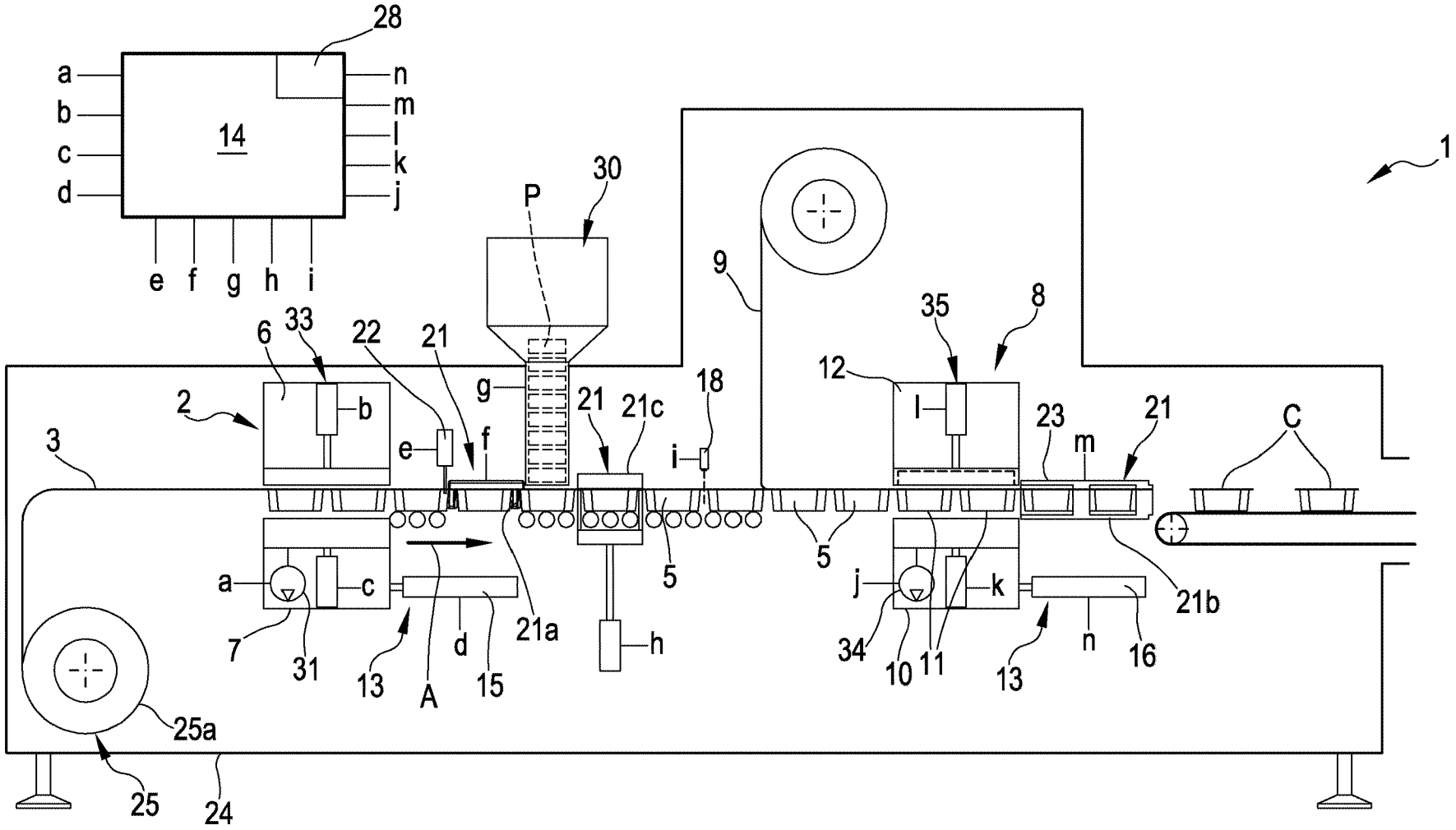
Figure 6:
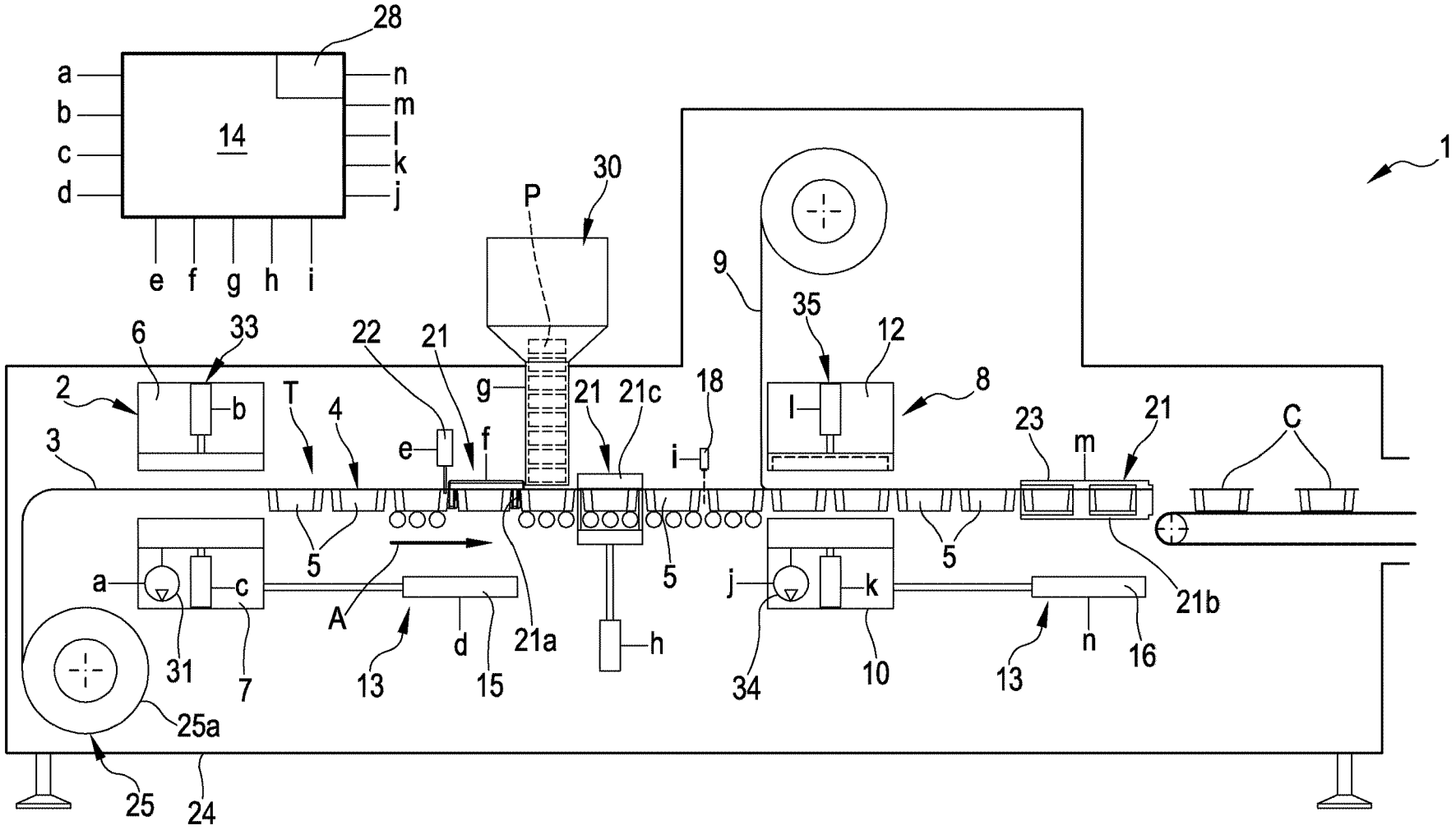
Figure 7:
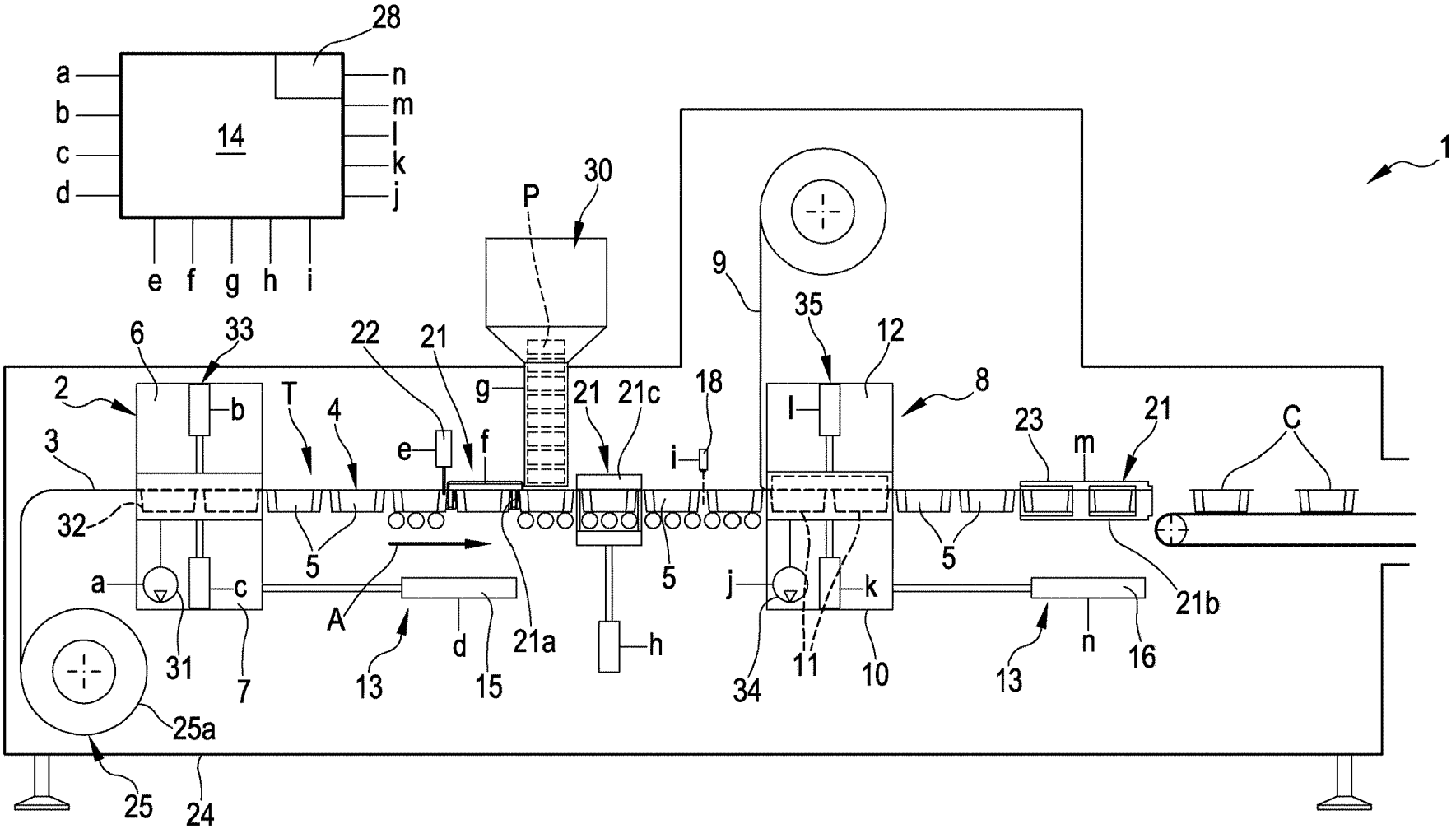

Still more particularly, the upper tool 12 and lower tool 10 are relatively movable with respect to each other between and open condition and a closed condition. In the open condition of the packaging station 8, the upper tool 12 and lower tool 10 are spaced from each other and enable to position one or more tray-shaped elements 5 in the seats 11 and position said portion of the closing film 9 above one or more respective tray-shaped elements 5 (this condition is illustrated in FIGS. 5 and 6). In the closed condition of the packaging station, the upper tool 12 and lower tool 10 are approached to each other for blocking or stably positioning the one or more tray-shaped elements 5 present in said seats 11 with respect to the packaging station 8 and for fixing the closing film 9 to such one or more respective tray-shaped elements 5 present in said seats 11.

As it is for example visible in FIGS. from 1 to 7, the packaging station 8 comprises also a respective actuating system 35 configured for placing the lower 10 and upper tools 12 in the open and closed conditions. In a non limiting way, the actuating system 35 can comprise an actuator, for example a hydraulic or pneumatic actuator, configured for engaging both the tools and moving them by approaching and distancing them from each other in order to respectively define the closed and open conditions. The attached figures illustrate, in a non limiting way, an arrangement wherein the actuating system 35 comprises two independent actuators respectively acting on the lower tool 10 and upper tool 12; in such arrangement, the independent actuators are engaged, from one side, to the frame 24 and, from the other side, act on the respective tool 10, 12. Therefore, each tool is movable with respect to the fixed frame 24 in order to help the precursor body 4 and closing film 9 enter the packaging station 8.

As it is visible in FIGS. 12 and 13 for example, the precursor body 4 exhibits a maximum width L3 equal to or not very different (for example greater than) from a maximum width of the packaging station 8: both said widths are measured parallelly to each other and normal to an advancement direction A of the base film 3 and therefore of the precursor body 4 along the predetermined advancement path T. Specifically, the welding rods 36 of the packaging station 8 exhibit a maximum width substantially equal to or slightly different (for example 1-5 mm greater or 1-5 mm smaller) from the maximum transversal width of the precursor body 4 and closing film 9. Advantageously, the closing film 9 exhibits a maximum transversal width L4 substantially equal to or slightly different (for example 1-5 mm greater or 1-5 lower) from the maximum transversal width of the precursor body 4. FIG. 13 shows a non limiting example wherein the maximum transversal width of the closing film 9 is equal to the maximum transversal width of the welding rods 36 of the packaging station 8. The above cited widths are all measured parallelly to each other and normal to the advancement direction A of the base film 3—therefore the advancement direction of the precursors body 4—along the predetermined advancement path T.

As hereinbefore briefly stated, the apparatus 1 can comprise a control unit 14; such unit 14 is advantageously connected to the actuating systems 33 and 35 of the forming 2 and packaging stations for managing respectively the open/closed positions and the open/closed conditions. Specifically, the control unit 14 is connected to the actuators of the actuating systems 33, 35 for commanding to open and close the stations 2 and 8. Advantageously, the control unit 14 is configured for synchronizing the actuating systems so that the open position of the forming station 2 is defined simultaneously or substantially simultaneously with the open condition of the packaging station, while the closing position of the forming station is defined simultaneously with the closed condition of the packaging station. More particularly, the apparatus 1 according to the invention uses at least one control unit 14 which can comprise a respective digital processor (CPU) with the memory (or memories) 28, an analog-type circuit, or a combination of one or more digital processing units with one or more analog-type circuits. The description and claims disclose that the control unit 14 can be "configured" or "programmed" for performing some steps: these can be executed substantially with any means enabling to configure or program the control unit 14. For example, in case of a control unit 14 comprising one or more CPUs and one or more memories, one or more programs can be stored in suitable memory banks 28 connected to the CPU or CPUs; the program or programs contain instructions which, when executed by the CUP or CPUs, program or configure the control unit 14 for executing the described operations (see the above detailed description and summary or the attached claims) with reference to the control unit 14. Alternatively, if the control unit 14 is or comprises an analog-type circuitry, then the control unit 14 circuit can be designed for including a circuitry configured, during the use, for processing electric signals in order to perform the steps regarding the above described control unit 14 or claimed in the following.

As it is visible in the attached figures, the apparatus 1 can comprise at least one stop group 21 configured for acting on at least one selected in the group of: the base film 3, the precursor body 4 formed by the forming station 2, the packages C formed by the packaging station 8. The stop group 21 is configured for being displaced between at least one released condition, wherein it enables to move respectively the precursor body 4 or said packages C along the advancement path T, and a gripping condition, wherein the stop group 21 respectively acts on the precursor body 4 or on said packages C, for preventing a movement along the advancement path T.

From the structural point of view, the stop group 21 can comprise a kind of opening-closing vice having substantially a lower portion and upper portion movable between the release condition and the gripping one. The lower portion is configured for acting on at least one lower portion of the following elements: the base film 3, precursor body 4, packages C. On the contrary, the upper portion is configured for acting on at least one upper portion of the following elements: base film 3, precursor body 4, packages C.

As it is visible in FIGS. from 1 to 7, for example, the stop group 21 comprises also a respective actuating system configured for placing the lower and upper portions in the release and gripping conditions. In a non limiting way, the actuating system of the stop group 21 can comprise an actuator, for example a hydraulic or pneumatic actuator, configured for engaging both the portions and moving them by approaching and distancing them from each other for respectively defining the release and gripping conditions. The attached figures illustrate, in a non limiting way, an arrangement wherein the actuating system of the stop group 21 comprises two independent actuators respectively acting on the lower and upper portions. More particularly, each portion is movable with respect to the fixed frame 24; in such arrangement, each independent actuator is engaged, from one side, to the frame 24 and, from the other side, to the respective lower and upper portions.

Advantageously, also the conditions of the stop group 21 can be controlled by a control unit (see FIGS. from 1 to 7); de facto, the control unit 14 is configured for commanding the stop group 21 to move and remain in said gripping condition when the forming station 2 is in the open position and/or when the packaging station 8 is in the open condition. Particularly, the control unit 14 is connected to the actuators of the actuating system of the group 21 for commanding to open and close the same. Advantageously, the control unit 14 is configured for synchronizing the actuating systems of the stations 2 and 8 with the actuating systems of the stop group 21. Specifically, the control unit 14 is active on the actuators of the respective systems so that the position and, respectively, the open condition of the stations 2 and 8 are defined during the gripping condition of the stop group 21 while the position and, respectively, the closed condition of the stations 2 and 8 are defined during the release condition of the stop group 21. De facto, the control unit 14 enables to grippingly arrange the stop group 21 when the precursor body is substantially free from the stations 2 and 8 so that the same base film precursor body and/or packages can be closed and stabilized in a predetermined and fixed longitudinal position for a determined time interval substantially equal to the time required to the forming and packaging stations 2 and 8 for performing the return stroke thereof during which such stations remain in an open position and, respectively, in an open condition or any case not in a closed position/condition for preventing a mechanical interference with the precursor body or base film during the return stroke.

The attached figures illustrate an arrangement wherein a plurality of stop groups 21 are present in a non limiting way. Specifically, the illustrated apparatus 1 can comprise a first stop group 21*a* active on said precursor body 4 and operating in an area comprised between said forming station 2 and said packaging station 8 (illustrated condition), or active on said base film 3 and operating upstream the forming station 2. Moreover, the apparatus 1 can comprise a second stop group 21*b* active on said precursor body 4 and operating in an area comprised between said forming station 2 and said packaging station 8, or active on said packages C downstream the packaging station 8. The control unit 14 is configured for commanding the first and second stop groups 21*a*, 21*b* to move substantially simultaneously and remain both in said gripping condition when said forming station 2 is in said open position and/or when said packaging station 8 is in said open condition (for releasing the precursor body and packages and returning to the starting position, respectively).

The attached figures illustrate a further arrangement of the apparatus 1 wherein three stop groups 21 are substantially present: a first group 21*a* immediately downstream the forming station along the advancement direction A, and a second stop group immediately downstream the packaging station 8 along the advancement direction A. In the illustrated arrangement, it is further present a third stop group 21*c* interposed between the first group 21*a* and packaging station 8, particularly the third stop group 21*c* is interposed between the supplying station 30 and packaging station 8.

The apparatus 1 can also comprise a piercing unit 40 (see FIG. 8) provided with a piercing tool 41 capable of being moved from a rest condition, wherein is away from the precursor body, and an operative condition wherein the piercing tool acts on said precursor body by making at least one through opening 42 (a hole or notch for example) on said lateral wall of a respective pre-shaped element. The through opening—preferably formed by notching and forming one or more reclosable flaps—enables—once the precursor body has reached the packaging station—to extract and introduce efficiently a gas from and towards the interior of each tray-shaped element. For example, plural piercing tools configured for performing an array of through openings on each tray-shaped element can be provided. The piercing unit 40 can act and be housed at the packaging station, as illustrated for example in the PCT patent application WO2014060507; in this case, the piercing unit can comprise a tubular tool 41 and therefore can be connected to the at least partial vacuum forming group in the packaging chamber and/or to the controlled atmosphere forming group (not illustrated in the attached figures) capable of injecting, in the packaging chamber, a gas or a mixture of gas having a controlled composition and different from the atmosphere. Alternatively, the piercing unit 40 can be placed upstream the packaging station, as it is also illustrated in FIG. 8, and form a distinct unit or can be integrated in one of the herein described stop groups by piercingly acting when the stop group is grippingly placed on the precursor body.

As it is visible in the attached figures, the apparatus 1 can further comprise a marking member 22 also stably supported by the fixed frame 24 and capable of making on the base film 3 or precursor body 4, during an operative condition of the same member 22, at least one reference, particularly a reference notch. The marking member 22 is placed upstream the packaging station 8 with the respect to the advancement direction A of the base film 3 and, particularly, upstream the supplying station 30. The attached figures illustrate, in a non limiting way, an arrangement of the apparatus wherein the marking member 22 is interposed between the first stop group 21*a* and forming station 22. The marking member 22 can comprise, for example, a punch or knife configured for acting on the base film 3 or precursor body 4 for making said reference 19, particularly said reference notch, readable by a detecting device of an optical or acoustic or mechanical type. The control unit 14 is also connected to the marking member 22; particularly, the control unit 14 is configured for defining the activation condition of the marking member 22 and synchronizing such condition with the gripping condition of the stop group 21, and particularly during the open positions and condition of the stations 2 and 8. Alternatively, the marking member can be configured for applying a mark, for example by painting or a laser radiation or heat, so that is "visible" by a suitable optical or acoustic sensor.

As it is visible in the attached figures, the apparatus 1 can further comprise at least one sensor member 18 integrally supported by the fixed frame 24 or packaging station 8. The sensor member 18 is detectingly active on said precursor body 4 and is capable to detect at least one of:

one or more references 19 made on said precursor body 4;

one or more of said tray-shaped elements 5 present in said precursor body 4.

The sensor member 18 is configured for emitting and supplying to the control unit 14 an activation signal when one or more of said references 19 are detected or, respectively, one or more of said tray-shaped elements 5 are detected. The sensor member 18 can comprise, for example, a feeler, an optical sensor, an acoustic sensor or any type of sensor capable of detecting the reference created by the marking member or the passage of a predetermined point of each tray-shaped element (for example the beginning of a recess). By means of the reference 19 and member 19, the control unit 14 can accurately determine the displacement of the precursor body 4 along the advancement path T.

As it is visible in the attached figures, the apparatus 1 can further comprise at least one cutting unit 23 supported by the frame 24 and placed downstream the packaging station 8 with respect to the advancement direction A of the film 3; the cutting unit 23 is configured for separating transversally and/or longitudinally the packages C into units distinct from each other comprising each one or more tray elements 5. The cutting unit 23 is configured for cuttingly acting on the precursor body and/or closing film applied to it. The attached figures illustrate a preferred but non limiting embodiment of the invention wherein the cutting unit 23 is integrated with the second stop group 21*b*.

Further, the apparatus 1 comprises at least one movement device 13 engaged to the fixed frame 24 and configured for moving, along the predetermined advancement path T, at least one of said forming 2 and packaging stations 8.

Specifically, the movement device 13 is active on the forming station 2 and is configured for moving this latter from a respective starting position, along a forward stroke along said predetermined advancement path T, until it reaches a respective arrival position. De facto, during the movement of the forming station 2, for the forward stroke, such station moves along the advancement direction A by approaching to the supplying station 30. Further, the device 13 is configured for moving the station from the arrival position, for a return stroke along said predetermined advancement path T opposite to the forward stroke, until it reaches a respective starting position. De facto, during the movement of the forming station 2, along the return stroke, such station moves along the advancement direction A away from the supplying station 30. Still in other words, the forming station 2 moves along the return stroke oppositely to the advancement direction A of the base film 3 and therefore of the precursor body 4.

Moreover, the movement device 13 is active on the packaging station 8 and is configured for moving this latter from a respective starting position along a forward stroke along said predetermined advancement path T, until it reaches a respective arrival position. De facto, during the movement of the packaging station 8, for the forward stroke, such station 8 moves along the advancement direction A away from the supplying station 30. Further, the device 13 is configured for moving the packaging station 8 from the arrival position, for a return stroke along said predetermined advancement path T opposite to the forward stroke, until it reaches a respective starting position. De facto, during the movement of the packaging station 8 along the return stroke, such station 8 moves along the advancement direction A by approaching to the supplying station 30. Still in other words, the packaging station 8 along the return stroke moves in a direction opposite to the advancement direction A of the base film 3 and therefore of the precursor body 4. In the embodiment illustrated in the attached figures, the movement device 13 is active both on the forming station 2 and packaging station 8 and is configured for moving, along said predetermined advancement path T, said precursor body 4, both said forming 2 and packaging stations 8 along the respective forward and return strokes. The forward strokes (respectively the return strokes) of said forming 2 and packaging stations 8 exhibit a minimum length measured along the advancement path T, which generally is at least equal to or a multiple of the on-center between two longitudinally consecutive tray-shaped elements. The forward strokes are substantially equal to each other and particularly are generally a submultiple of the predetermined distance between stations 2 and 8, which preferably remains substantially unaltered during the process except for slight compensations destined to account for a possible longitudinal deformation of the base film and/or precursor body.

By specifically studying now the structure of the moving device 13, it is possible to observe—FIGS. 1, from 2 to 7—that the same in a first embodiment comprises at least one first actuator member 15 active on the forming station 2 and configured for reciprocally moving the station itself along the respective forward stroke and return stroke. Still in this embodiment, the movement device 13 comprises at least one second actuator member 16 independent from the first actuator member 15, active on the packaging station 8 and configured for reciprocally moving the packaging station 8 along the respective forward stroke and return stroke of the packaging station 8. De facto, in such arrangement, the reciprocal movements along the advancement path of the stations 2 and 8 are independently managed by the actuators 15, 16. In a preferred embodiment of the invention, the movement device 13 is connected to the control unit 14 which is configured for managing the first and second actuators 15, 16; particularly, the control unit 14 is configured for synchronizing the movement of the forming station 2 and packaging station 8 both along the respective forward strokes (which therefore start in the same instant and last substantially for the same time interval) both along the respective return strokes (which therefore start in the same instant and substantially last for the same time interval). In such embodiment (the actuators 15 and 16 are independent), the control unit 14 is configured for commanding the first and/or second actuators 15, 16 to be able to slightly change the predetermined distance as a function of the forward stroke given to said forming 2 and packaging stations 8. De facto, the control unit 14, besides moving the stations 2 and 8 along the forward and return strokes, can manage the distance between the two stations 2, 8 so that the same can always operate with a suitable relative position. In a preferred embodiment of the invention, this type of control (relative position) is performed by using the sensor members 18; particularly, the control unit 14 is connected to the sensor member 18 and is configured for: receiving the activation signal, determining by said activation signal a position of the tray-shaped elements 5 to be closed, moving the packaging station 8 from the respective arrival position, for a return stroke opposite to the forward stroke, until it returns to the new starting position wherein the packaging station 8 is centered with respect to the determined position of the tray-shaped elements 5 to be closed.

Figure 1A:
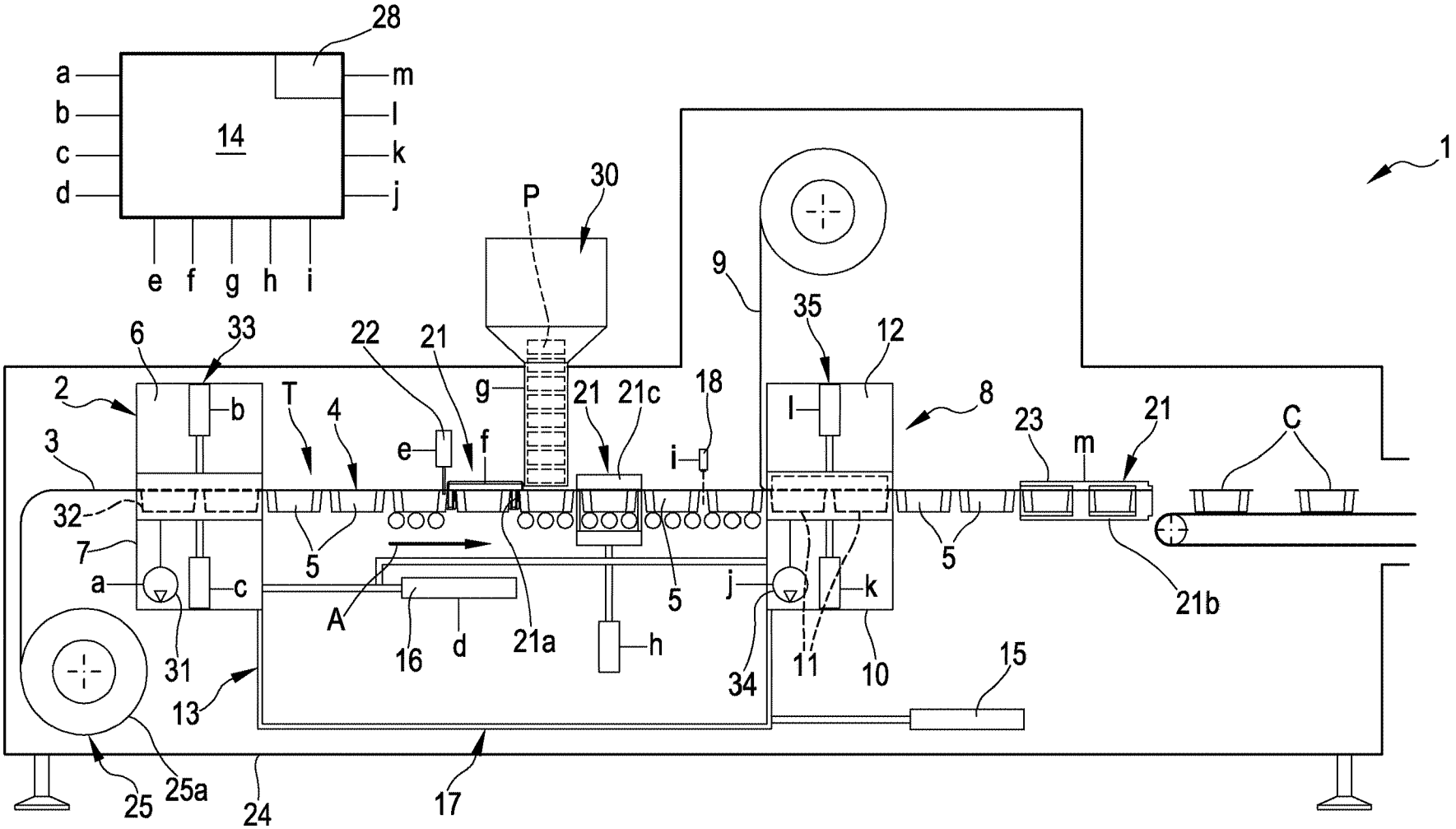
FIG. 1A is a schematic view of a second embodiment of an apparatus according to the present invention.
Figure 2:
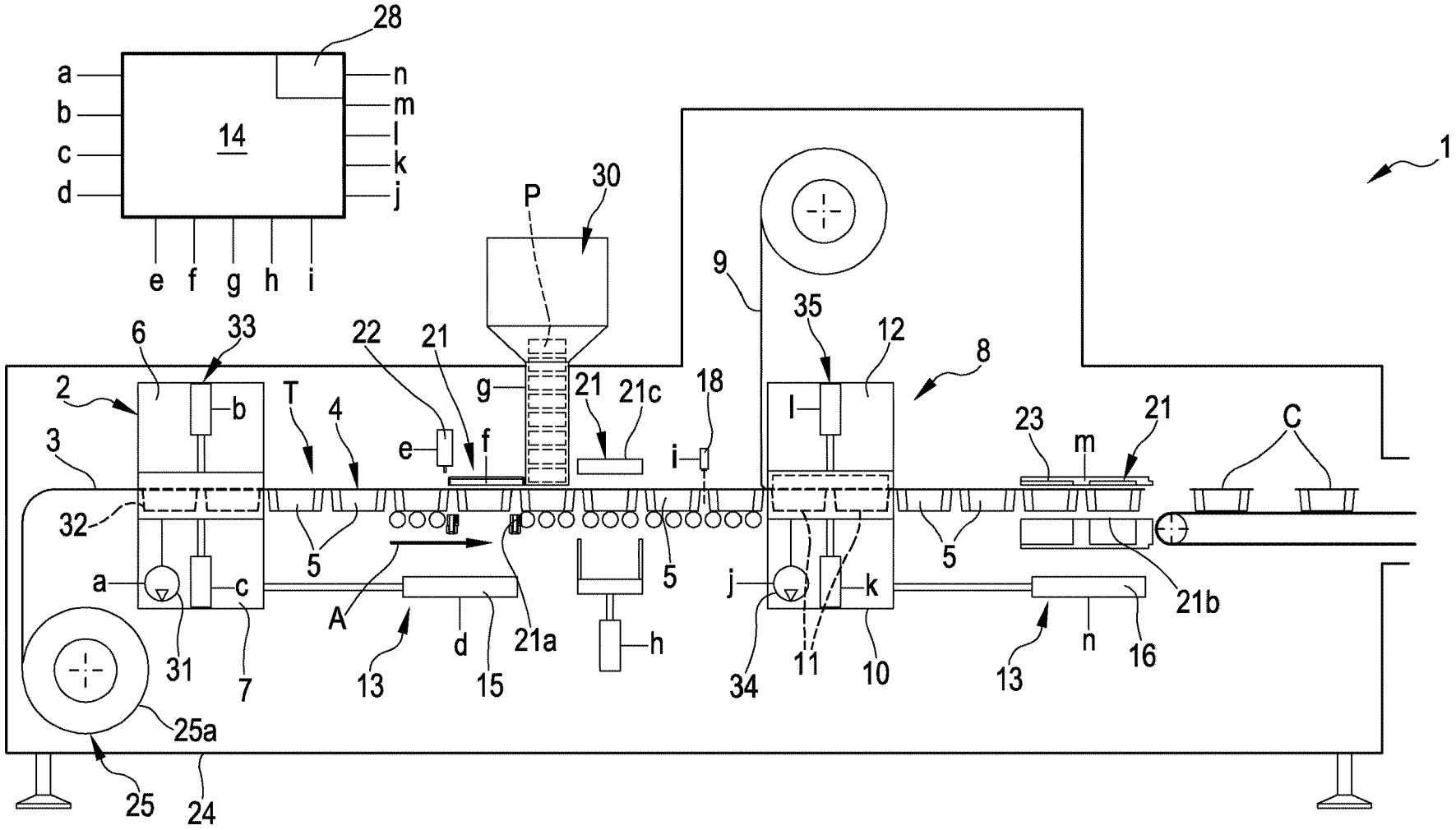
Figure 3:
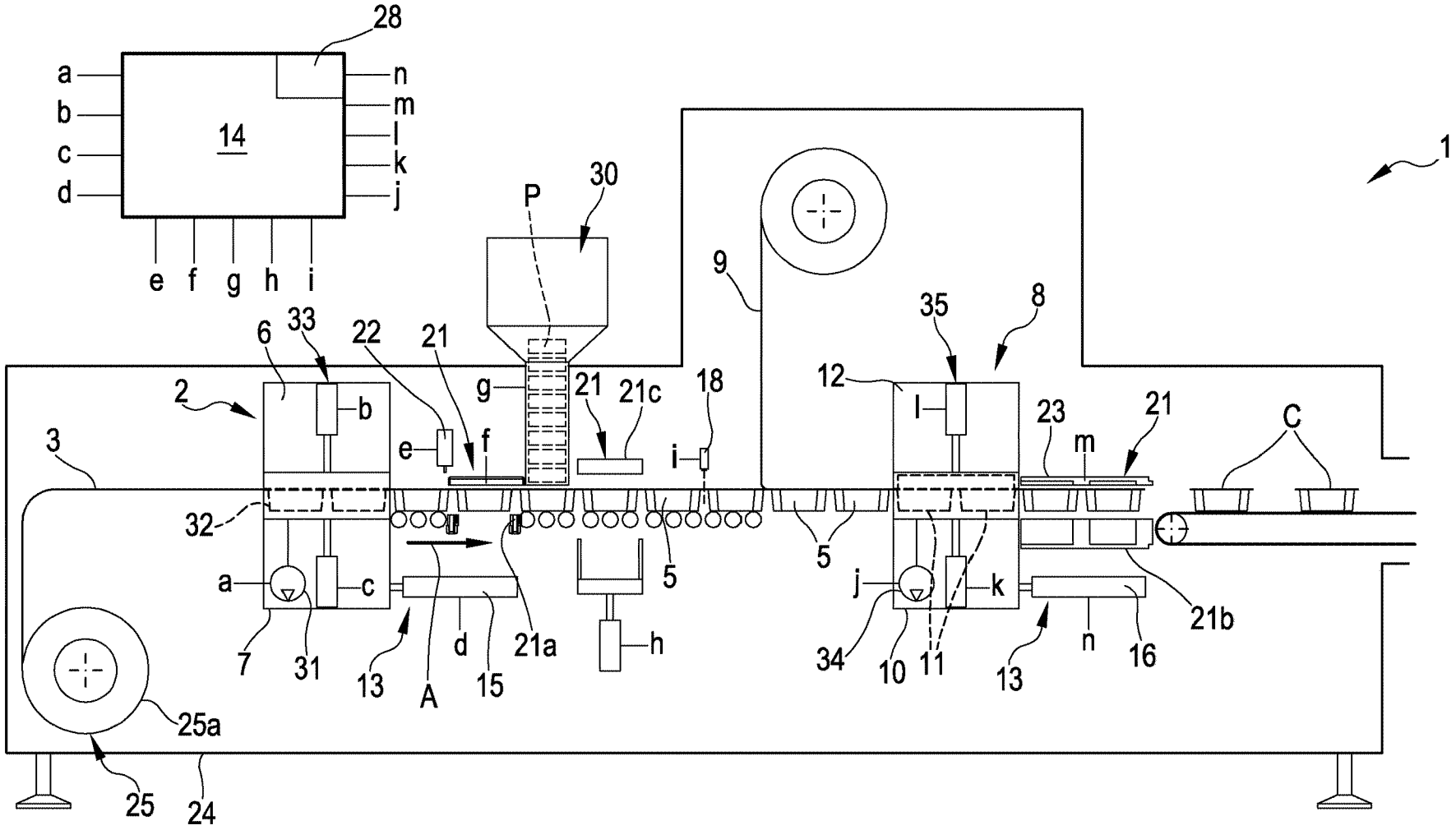
Figure 4:
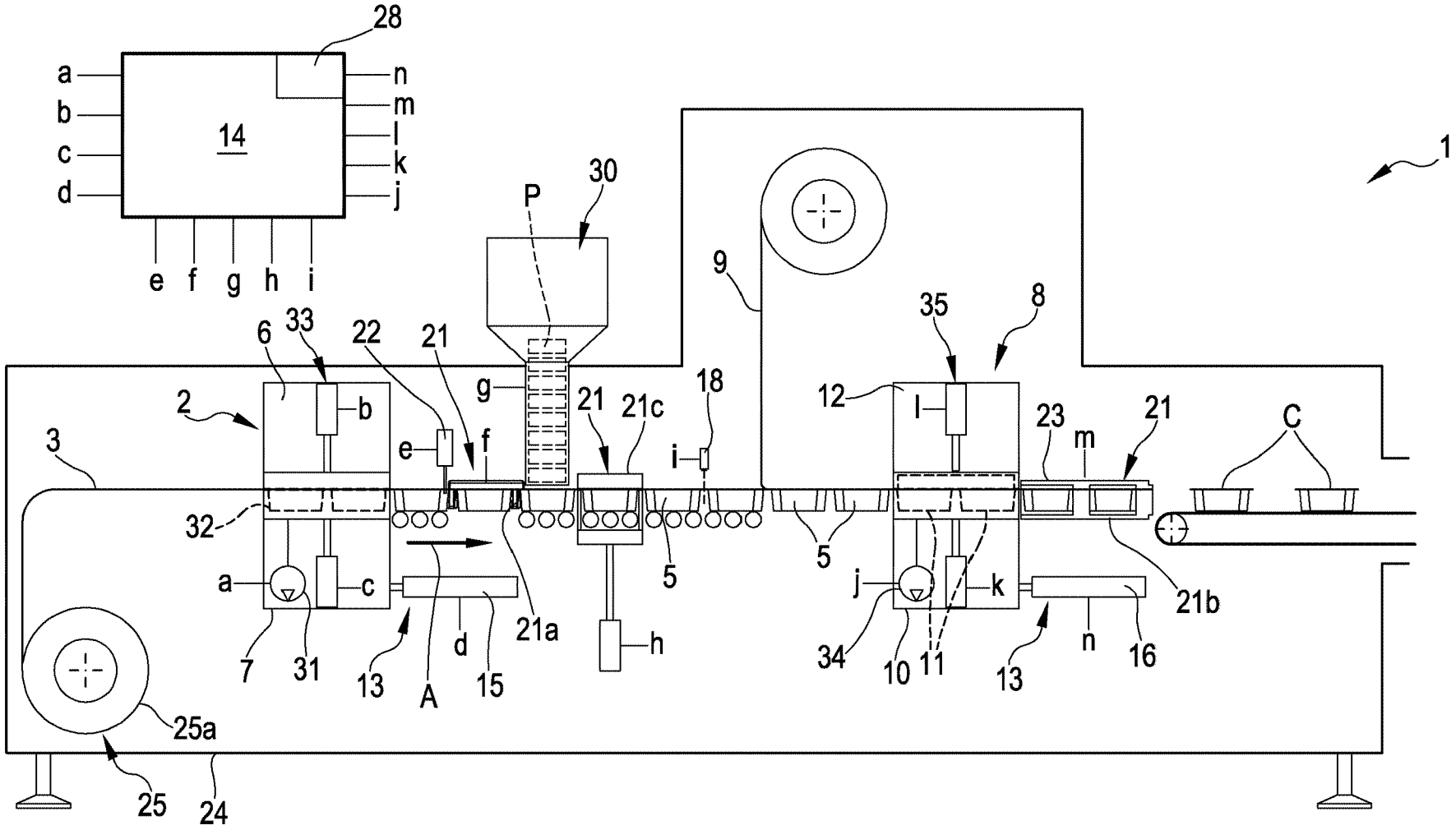

In a second embodiment of the apparatus 1, visible in FIG. 1A, the movement device 13 comprises a slide 17 engaged with the frame 24 and arranged to support the forming 2 and packaging station 8: the stations 2 and 8 are connected by the slide 17 so that the same are constrained to have their main movement. Also in the embodiment in FIG. 1A, the device 13 comprises a first actuator member 15 active on the slide 17 and configured for reciprocally moving such slide 17 and then the forming station 2 and packaging station 8 along a same common forward stroke and a same common return stroke. De facto, the first actuator 15 is configured for moving the whole slide 17 and therefore the stations 2 and 8 simultaneously along the respective forward and return strokes. However, also the embodiment in FIG. 1A provides to adjust the relative position between the stations 2 and 8 by a second actuator member 16 of the device 13 which is supported by said slide 17 and is active on at least one of said forming station 2 and packaging station 8: the second actuator member 16 is configured for changing the relative distance between the same stations 2 and 8.

De facto, in both the described embodiments, the movement device 13 is advantageously managed by the control unit 14 which is active both on the forming 2 and packaging stations 8, and the actuating systems 33 and 35 of the stations 2 and 8 (systems for closing and opening the stations). As hereinbefore described, the control unit 14 is configured for commanding the forming station 2 to move between the respective open position and respective closed position and further commanding the packaging station 8 to move between the respective open condition and respective closed condition. The control unit 14, active on the device 13, is configured for commanding this latter by synchronizing the movements of the actuating systems 33 and 35; particularly, the control unit 14 is configured for commanding at least one of the following displacements:

- a displacement of the forming station 2 along the predetermined advancement path T at least when the forming station 2 is in said closed position;
- a movement of the packaging station 8 along the predetermined advancement path T at least when the packaging station 8 is in said closed condition.

Therefore, the control unit 14 is configured for coordinating the movement of the forming station 2 between the respective open position and the respective closed position, with the movement of the packaging station 8 between the respective open condition and respective closed condition, and with said at least one displacement applied by the movement device 13 for conferring to the precursor body 4 a step-by-step discontinuous movement along said predetermined advancement path T. Specifically, the control unit 14 is configured for synchronizing the forward stroke of the forming station 2 with the forward stroke of the packaging station 8, and for synchronizing the return stroke of the forming station 2 with the return stroke of the packaging station 8.

More specifically, the control unit 14 is configured for commanding the movement device 13 to apply a movement to the forming station 2 along said predetermined advancement path T when the forming station 2 is in the closed position. Moreover, the control unit 14 is configured for commanding the movement device 13 to apply a movement to the packaging station 8 along said predetermined advancement path T at least when the packaging station 8 is in said closed condition.

The movement applied by the device 13 is when the forming station 2 and packaging station 8 are respectively in the closed position and in the closed condition and enables the same stations to simultaneously move the base film 3, precursor body 4, and packages C along the advancement path and particularly in the advancement direction A, particularly from the supplying station 25 exiting the packaging station 8.

Advantageously, the control unit 14 is also configured for commanding the forming station 2 to be placed in respective closed position and forming said tray-shaped elements 5 during said forward stroke (particularly, the forming station is in a closed position before starting the forward stroke). Moreover, the control unit 14 can be advantageously configured for commanding the forming station 2 to be placed in said open position during said return stroke. In this way, the control unit 14 can minimize the times required for forming the elements 5 and moving the precursor body 4.

Analogously, the control unit 14 can be configured for commanding the packaging station 8 to be placed in said respective closed condition, and fixing said portion of the closing film 9 to one or more respective tray-shaped elements 5 present in said seats 11, during said forward stroke (particularly the packaging station is in the closed condition before starting the forward stroke). Moreover, the control unit 14 can command the packaging station 8 to be placed in said open position during said return stroke.

More particularly, the control unit 14 is connected to said first and second actuators 15, 16 and is configured for applying to the forward stroke of the forming station 2 a first displacement value for applying to the forward stroke of the packaging station 8 a second displacement value different from the first displacement value, optionally wherein:

- or the first and the second displacement values are both predetermined,
- or the first displacement value is predetermined, while the second displacement value is calculated by the control unit 14 as a function of the first displacement value,
- or the first displacement value is predetermined, while the second displacement value is calculated by the control unit 14 as a function of the first displacement value, and as a function of a deformation regarding a longitudinal strain of the precursor body 4 between the forming station 2 and the packaging station 8.

Advantageously but non in a limiting way, the control unit 14 is connected to said first and second actuators 15, 16, and is configured for applying to the return stroke of the forming station 2 a third displacement value, and for applying to the return stroke of the packaging station 8 a fourth displacement value equal to or different from the third displacement value.

The third and fourth displacement values are one of the following:

- the third and fourth displacement values are both predetermined values,
- the third and fourth displacement values are predetermined and respectively equal to the first and second displacement values,
- the third displacement value is predetermined, and preferably equal to the first displacement value, while the fourth displacement value is calculated by the control unit 14 as a function of the first displacement value or of the third displacement value,
- the third displacement value is predetermined, and preferably equal to the first displacement value, while the fourth displacement value is calculated by the control unit 14 as a function of the first displacement value or of the third displacement value, and as a function of a deformation regarding a longitudinal deformation of the precursor body 4 between the forming station 2 and the packaging station 8. The value of the return stroke of the packaging station can also, as an alternative, be determined by the control unit based on the information received from the sensor 18.

As hereinbefore described, the displacement value of the forward strokes (and also of the return strokes) between the two stations 2 and 8 are small with respect to the overall length of the stroke: the differences are substantially tied to the expected or detected longitudinal deformations exhibited by the base film and/or precursor body.

Moreover, the control unit 14 can be arranged for storing, in a memory forming part of the unit itself or connected to this latter, a plurality of lengths values to be applied to the forward and return strokes of the forming station 2, and/or a plurality of length values to be applied to the forward and return strokes of the packaging station 8. Moreover, the control unit 14 is configured for:

- receiving an information regarding the type of tray-shaped elements 5 formable by means the forming station 2, and
- selecting from said memory 28, based on said information, the value to be applied to one or more of:
  - a forward stroke of the forming station 2,
  - a return stroke of the forming station 2,
  - a forward and return strokes of the forming station 2,
  - a forward stroke of the packaging station 8,
  - a return stroke of the packaging station 8,
  - a forward and return strokes of the packaging station 8.

In other words, as a function of the type and therefore of the size of the tray elements, the control unit is configured for correspondingly selecting the forward and/or return strokes of the forming station, and also the forward and/return strokes of the packaging station. Once again it is observed that the stroke of the packaging station can be slightly adapted in order to account for possible longitudinal deformations of the base film or precursor body, in particular.

The information about the type of tray-shaped elements 5 can be for example received by the control unit 14 through an input signal from a user interface connected to the control unit itself, or from a sensor active on the forming station 2 and capable of identifying the type of tray-shaped elements 5 formable by means of the forming station 2, or from a sensor active on the precursor body 4 and capable of identifying the type of tray-shaped elements 5 formed by the forming station 2.

Process for Packaging Products

Moreover, it is an object of the present invention a process for packaging products C using the apparatus 1 according to the above given description and according to anyone of the attached claims.

The process comprises the step of unwinding the base film 3 from the supplying station 25 by advancing it towards the forming station: specifically, as it will be described in the following, the forming station moves and abuts, at each cycle, against a longitudinal following segment of the film which therefore is advanced and processed for forming the tray-shaped elements 5. Downstream the supplying station, indeed, the base film enters the forming station 2 which provides to form in the film itself a predetermined number of tray-shaped elements 5. Particularly, the tray-shaped elements are defined—at each cycle—in correspondence of a longitudinal segment of the base film 3, by progressively forming in this way a continuous precursor body 4 provided with tray-shaped elements 5 adjacent to each other which then enter the packaging station 8.

Between the forming and the packaging stations, there is the supplying station which provides to place one or more products to be packaged into the tray-shaped elements 5, before entering the packaging station. Alternatively, trained personnel can load the products and in this case the supplying station can be optional. The packaging station receives a longitudinal segment of a closing film 9 from a respective roll and applies such closing film to a predetermined number of tray-shaped elements 5 of the precursor body 4 present in the packaging station 8. During the steps of forming the tray-shaped elements, the forming station is in a closed position and moves from the starting position along the respective forward stroke; substantially during the same time interval, the packaging station 8 is in a closed condition and moves along its forward stroke. The forming station and packaging station, once they have traversed the respective forward strokes, return to the respective starting positions: in other words, the forming station, once it has traversed its forward stroke, moves to an open position, releases the precursor body and returns to the starting position wherein it will start a new cycle of forming and transporting the base film 34. In turn, the packaging station, once it has traversed, its forward stroke, moves to the open condition, releases the precursor body and/or the packaged trays and returns towards its own starting position wherein it will start a new cycle of transporting the precursor body and fixing the closing film. Due to their motion as hereinbefore described, the stations 2 and 8 apply at least to the base film 3 and precursor body 4 a step-by-step movement along a predetermined advancement path T.

More precisely, in the embodiment illustrated in the attached figures, the step-by-step movement applied to the base film and precursor body comprises:

- moving the forming station 2 along the advancement path T along a forward stroke from a starting point until it reaches an arrival point: during the step of moving the forming station 2 along the forward stroke, such station remains in the respective closed position and forms the predetermined number of tray-shaped elements 5 in the base film 3, moving the packaging station 8 along the advancement path T along a forward stroke from a starting point until it reaches an arrival point; the step of moving the packaging station 8 along the forward stroke is substantially synchronous with the forward stroke of the forward station; during such step, the packaging station remains in the respective closed condition and attached a longitudinal segment of the closing film 9 to a predetermined number of tray-shaped elements 5 present in the packaging station 8, after, the forming station and packaging station have traversed the respective forward strokes, the forming station 2 is moved along a return stroke to return to the respective starting point: during the step of moving the forming station 2 along the return stroke, such station remains in the respective open position for not interfering with the precursor body and/or base film, moving the packaging station 8 along a return stroke until it returns to the previous or a new respective starting point: the said step of moving the packaging station 8 along the return stroke is substantially synchronous with the return stroke of the forming station; during said step of moving the packaging station 8 along the return stroke, such station remains in the respective open condition for not interfering with the precursor body.

The above described steps are cyclically repeated so that at each cycle the precursor body, base film and packaged trays exiting the packaging station, advance by a step while a new segment of the base film is formed and while a new segment of the precursor body is sealed to a respective segment of the closing film.

As it was previously described, the apparatus 1 comprises one or more stop groups acting when (or immediately before) the forming station and packaging station respectively move to an open position and open condition for blocking the base film and/or precursor body and enable, as said, to apply the step-by-step movement to the base film 3 of the precursor body 4. Specifically, the stop group or groups perform a step of stopping the precursor body 4 and/or base film 3 obtained by holding the base film 3 and/or precursor body 4 by operating the stop group/groups on the base film and/or precursor body during said return strokes of the forming station and packaging station 8.

In other words, therefore, during the step of forming the tray-shaped elements 5, the forming station 2 is in a closed position, blocking a longitudinal segment of the base film 3 with respect to the forming station, and during the step of fixing said longitudinal segment of the closing film 9 to the predetermined number of tray-shaped elements 5, the packaging station 8 is in said closing condition so that it blocks a segment of the precursor body 4 and closing film 9 with respect to the packaging station 8, so that the precursor body 4 is moved along the advancement path exclusively by the movement applied to it by the forming station 2 and packaging station 8. As soon as the stations 2 and 8 release the precursor body and/or trays, the stop group/groups act for longitudinally stopping the advancement of the base film and/or precursor body, so that the stations 2 and 8 can return to the respective starting positions without moving neither the precursor body nor the base film.

The packaging station, during its forward stroke (besides sealing the closing film to the tray) can comprise a step of forming a vacuum (or a low-pressure state having a predetermined level) inside the packaging chamber so that the closing film is attached to the precursor body, and particularly to each respective tray-shaped element only after forming the desired level of vacuum inside this latter. Therefore, the closing film is sealed to the flange of each tray and follows the outline of the product and of the inner portion of the tray which is not occupied by the product. Alternatively, the packaging station during the forward stroke (besides sealing the closing film to the tray) can form a controlled atmosphere inside the packaging station and therefore inside each tray. Obviously, the packaging station, during the forward stroke, can be alternatively controlled for not forming neither a vacuum nor a controlled atmosphere, but by simply sealing the closing film to each tray-shaped element. It should be kept in mind that due to the invention, the steps of packaging and possibly forming the vacuum (skin package) or a controlled atmosphere (modified atmosphere packaging, MAP), are performed during the forward stroke of the packaging station, and also the step of forming the tray-shaped elements is performed during the forward stroke of the forming station, so that the whole process is therefore provided with a great efficiency. According to a variant, the piercing unit 40 can operate in the packaging station and can be controlled by the control unit in order to pierce the lateral wall of the tray of trays during the forward stroke: further, as previously cited, the piercing tool 41 can be tubular and be connected to the vacuum group and/or controlled atmosphere forming group. By this arrangement, the piercing tool 41 can be used—always by the control of the control unit, for suctioning air (by forming a vacuum in the packaging chamber) or for blowing as at a controlled atmosphere.

According to another aspect, the base film 3 is supplied to the supplying station 25 and exhibits a width equal to or less than the width of the forming station; specifically, the base film enters the processing area of the forming station and exhibits a maximum width less than the maximum width of the closing perimeter delimiting the processing area: in other words, the segment of the base film inside the processing station does not have longitudinal edges laterally projecting from the working station itself but, on the contrary, exhibits a width which is strictly necessary for forming the tray elements 5. As hereinbefore said, it is noted that the above given maximum transversal widths must be measured parallelly to each other and normal to the advancement direction A. Further, the closing film 9 exhibits a width equal to or less than the width of the precursor body in order to cover the recess of each tray-shaped element and in order to be stably attached to the flanges of the tray elements, preferably without radially projecting with respect to the precursor body 4. Due to this provisions, since the base film and precursor body are moved by means of the stations 2 and 8, it is possible to maximize the saving of plastic material necessary for the packaging process.

According to a further aspect, it is possible to determine, for example automatically by the control unit, the forward stroke to be applied to said forming station 2 and/or packaging station 8 based on the type of tray-shaped elements 5 to be formed, and therefore to provide a step of adjusting the distance between the forming station 2 and packaging station 8 as a multiple of said forward stroke of the forming station 2 and/or packaging station 8, in other words as a multiple of the step applied to the precursor body at each forming/packaging cycle.

As stated with reference to the description regarding the apparatus, a marking member 22 can make on the base film or precursor body 4 at least one reference notch: for example the marking member can comprise a punch or knife which, during the return stroke of the forming and packaging stations, can act on the still base film 3 or precursor body 4, by making one or more reference notches which can be used for controlling the movement of the precursor body or for guiding the return stroke of the packaging station, as hereinbefore described.

Moreover, the apparatus 1 comprises a cutting unit 23 configured for separating transversally and/or longitudinally the packages C made by the packaging station by forming units distinct from each other comprising each one or more tray elements 5. The cutting unit cuttingly acts on the precursor body and/or closing film applied to it: the cutting unit can be incorporated in one of the stop groups and therefore can act when the stop group blocks the precursor body or the formed trays (for example, it can act as a die and separate from each other the tray-shaped elements). Alternatively, the cutting unit can be made as an independent unit active, for example, downstream the packaging station; it can be commanded for operating during the return stroke of the stations 2 and 8 or during the forward stroke of such stations at areas wherein there is no undesired interference with the movement of the stations (in order to act during the forward stroke, it should be longitudinally moved as the forming and cutting stations).

The invention claimed is:

1. Apparatus for packaging a product comprising:

a forming station configured for receiving a base film and forming by it a precursor body having a plurality of tray-shaped elements adjacent to each other, wherein the forming station comprises:

at least one upper portion, and at least one lower portion, the upper portion and lower portion being coupled to be movable with respect to each other between an open position of the forming station, wherein the upper portion and lower portion are spaced from each other and enable a longitudinal segment of the base film to enter the forming station, and a closed portion of the forming station, wherein the upper portion and lower portion are approached to each other for blocking said longitudinal segment of the base film with respect to the forming station and forming in such longitudinal segment one or more of said tray-shaped elements, a packaging station configured for receiving said precursor body and a closing film, the packaging station being configured for fixing the closing film to the precursor body at least at an upper opening of a predetermined number of said tray-shaped elements for forming packages flanked to each other, the packaging station, comprising in turn:

a lower tool comprising a predetermined number of seats each configured for receiving at least one of said tray-shaped elements, and an upper tool facing the lower tool and configured for cooperating with the lower tool for fixing at least a portion of said closing film to one or more tray-shaped elements placed in said seats, wherein the upper tool and lower tool are movable with respect to each other between an open condition of the packaging station, wherein the upper tool and lower tool are spaced from each other and enable to place one or more tray-shaped elements in said seats and to place said closing film portion above one or more respective tray-shaped elements, and a closed condition of the packaging station, wherein the upper tool and lower tool are approached to each other for blocking the one or more tray-shaped elements in said seats with respect to the packaging station and fixing said closing film portion to such one or more respective tray-shaped elements present in said seats, at least one movement device configured for moving, along a predetermined advancement path of said precursor body, at least one of said forming station and packaging stations, a control unit active on said forming station and packaging stations and also on the movement device, and configured for:

commanding a movement of the forming station between the respective open position and the respective closed position, commanding a movement of the packaging station between the respective open condition and the respective closed condition, commanding the movement device to perform at least one of the following:

a displacement of the forming station along said predetermined advancement path at least when the forming station is in said closed position, a displacement of the packaging station along said predetermined advancement path at least when the packaging station is in said closed condition, coordinating the movement of the forming station between the respective open position and the respective closed position, with the movement of the packaging station between the respective open condition and the respective closed condition, and with said at least one displacement performed by the movement device for conferring—to at least one longitudinal portion of the precursor body—a discontinuous step-by-step movement along said predetermined advancement path, and by the fact that the apparatus is configured so that at least to the longitudinal portion of the precursor body, the movement along said predetermined advancement path is exclusively applied by the forming station and packaging station themselves during a respective forward stroke.

2. Apparatus according to claim 1, wherein the movement device is active both on the forming station and the packaging station and is configured for moving, along said predetermined advancement path of said precursor body, both said forming station and packaging stations, and wherein the control unit is configured for:

commanding the movement device to perform a displacement of the forming station along said predetermined advancement path at least when the forming station is in said closed position, commanding the movement device to perform a displacement of the packaging station along said predetermined advancement path at least when the packaging station is in said closed condition.

3. Apparatus according to claim 1, wherein said movement device active on the forming station is configured for:

moving the forming station from a respective starting position, along a forward stroke along said predetermined advancement path, until it reaches a respective arrival position, and moving the forming station from the respective arrival position, for a return stroke opposite to the forward stroke, until it returns to a new respective starting position, and wherein the control unit is also configured for:

commanding the forming station to be placed in said respective closed position and to form said tray-shaped elements during said forward stroke, commanding the forming station to be placed in said open position during said return stroke.

4. Apparatus according to claim 1, wherein said movement device active on the packaging station is configured for:

moving the packaging station from a respective starting position, along a forward stroke along said predetermined advancement path, until it reaches a respective arrival position, and moving the packaging station from the respective arrival position, for a return stroke opposite to the forward stroke, until it returns to a new starting position, and wherein the control unit is also configured for:

commanding the packaging station to be placed in said respective closed condition, and fixing said closing film portion to one or more respective tray-shaped elements present in said seats, during said forward stroke, commanding the packaging station to be placed in said open position during said return stroke.

5. Apparatus according to claim 1, wherein said longitudinal portion of the precursor body extends between the forming station and packaging station when the forming station and packaging station are starting the respective forward strokes along said predetermined advancement path.

6. Apparatus according to claim 1, wherein the apparatus is configured so that the movement of the precursor body along the operative path at least between said forming station and said packaging station is exclusively applied by the forming station and packaging station themselves during the respective forward strokes.

7. Apparatus according to claim 1, wherein the apparatus is configured so that the movement of the base film up to the forming station be exclusively applied by the forming station and packaging station themselves during the respective forward strokes.

8. Apparatus according to claim 1, wherein said movement device comprises:

a first actuator member active on the forming station and configured for reciprocally moving the forming station along said forward stroke and return stroke of the forming station, and a second actuator member, independent from the first actuator, active on the packaging station and configured for reciprocally moving the packaging station along said forward stroke and return stroke of the packaging station;

or wherein the movement device comprises:

a slide arranged for supporting the forming station and the packaging station, a first actuator member active on the slide and configured for reciprocally moving such slide and therefore the forming station and the packaging station along a same common forward stroke and same common return stroke, and a second actuator member, carried by said slide and active on at least one of said forming station and packaging station, said second actuator member being configured for varying a distance with respect to the stations themselves;

and wherein the control unit is connected to said first and second actuator members and is configured for imposing on the forward stroke of the forming station a first displacement value and for imposing on the forward stroke of the packaging station a second displacement value different from the first displacement value, optionally wherein:

either the first and the second displacement values are both preset, or the first displacement value is preset, while the second displacement value is calculated by the control unit as a function of the first displacement value, or the first displacement value is preset, while the second displacement value is calculated by the control unit as a function of the first displacement value, and of a deformation information regarding a longitudinal deformation of the precursor body between the forming station and the packaging station.

9. Apparatus according to claim 8, wherein the control unit is connected to said first and second actuators and is configured for imposing on the return stroke of the forming station a third displacement value and for imposing on the return stroke of the packaging station a fourth displacement value equal to or different from the third displacement value; wherein said first and fourth displacement values are one of the following:

the third and fourth displacement values are both preset values, the third and fourth displacement values are preset and respectively equal to the first and second displacement values, the third displacement value is preset, and preferably equal to the first displacement value, while the fourth displacement value is calculated by the control unit as a function of the first displacement value or of the third displacement value, the third value is preset, and preferably equal to the first displacement value, while the fourth displacement value is calculated by the control unit as a function of the first displacement value or of the third displacement value, and of a deformation information regarding one longitudinal deformation of the precursor body between the forming station and the packaging station.

10. Apparatus according to claim 8, wherein said packaging station is placed at a predetermined distance from the forming station, said forward stroke of said forming station and/or packaging stations having a length which is a submultiple of said predetermined distance, optionally wherein said control unit is configured for commanding said first and/or second actuators and for varying said predetermined distance as a function of the forward stroke to be imposed said forming station and packaging stations.

11. Apparatus according to claim 1, wherein the control unit is configured for synchronizing the forward stroke of the forming station with a forward stroke of the packaging station and for synchronizing the return stroke of the forming station with the return stroke of the packaging station.

12. Apparatus according to claim 1, comprising at least one sensor member active in detection on said precursor body and capable of detecting at least one among:

one or more references made on said precursor body, one or more of said tray-shaped elements present in said precursor body, wherein said sensor member is configured for emitting and supplying to the control unit n activation signal upon the detection of one or more of said references or of one or more of said tray-shaped elements;

and wherein the control unit is connected to the sensor member and is configured for:

receiving said activation signal, determining from said activation signal a position of the tray-shaped elements to be closed, moving the packaging station from the respective arrival position, for a return stroke opposite to the forward stroke, until it returns to the new starting position wherein the packaging station is centered with respect to the determined position of the tray-shaped elements to be closed.

13. Apparatus according to claim 1, wherein said forming station, said packaging station and said movement device are carried by a fixed frame on which the advancement path of the base film and precursor body is defined, and wherein the apparatus further comprises at least one supplying station, optionally comprising a supplying roll, of said base film which exhibits a width having an extension equal or different for no more than 1 cm with respect to a width of the processing area of the forming station; the above mentioned widths are measured parallel to each other and normal to an advancement direction of the base film along the predetermined advancement path.

14. Apparatus according to claim 13, wherein the packaging station comprises at least one welding rod arranged to heat fix the closing film to said one or more tray-shaped elements of the precursor body, and wherein the welding rod exhibits a maximum width substantially equal to or slightly different—optionally from 1 to 5 mm greater or from 1 to 5 mm smaller—from the maximum transversal width of the precursor body and of the closing film; the above mentioned widths are all measured parallely to each other and normal to the advancement direction of the base film along the predetermined advancement path.

15. Apparatus according to claim 1, comprising at least one memory connected to the control unit and arranged to store:

a plurality of length values to be imposed the forward and return strokes of the forming station, and/or a plurality of length values to be imposed the forward and return strokes of the packaging station, and wherein the control unit is arranged to:

receive an information regarding the type of tray-shaped elements formable by the forming station, and select from said memory, based on said information, the value to be imposed to one or more of:

the forward stroke of the forming station, the return stroke of the forming station, the forward and return strokes of the forming station, the forward stroke of the packaging station, the return stroke of the packaging station, the forward and return strokes of the packaging station;

optionally, wherein said information is received by an input signal from an user interface connected to the control unit, or from a sensor active on the forming station and capable of identifying the type of tray-shaped elements formable by the forming station or by the sensor active on the precursor body and capable of identifying the type of tray-shaped elements formed by the forming station.

16. Packaging process using the apparatus according to claim 1, said process comprising the following steps:

forming, in the forming station, a predetermined number of tray-shaped elements at a longitudinal length of a base film, by making a continuous precursor body provided with tray-shaped elements adjacent to each other, placing one or more products to be packaged in said tray-shaped elements, fixing in the packaging station a longitudinal length of a closing film to a predetermined number of tray-shaped elements of the precursor body present in the packaging station, conferring at least to the base film and precursor body a step-by-step movement along a predetermined advancement path, wherein the step of conferring to the base film and precursor body a step-by-step movement provides to:

move said forming station along the advancement path with a forward stroke from a starting point in order to reach an arrival point, during said step of moving the forming station along the forward stroke, such station remaining in the respective closed position and forming in the base film the predetermined number of tray-shaped elements, and/or move the packaging station along the advancement path with a forward stroke from a starting point in order to reach an arrival point, during said step of moving the packaging station along the forward stroke, such station remaining in the respective closed condition and fixing said longitudinal segment of the closing film to the predetermined number of tray-shaped elements present in the packaging station, and wherein the step of conferring to the base film and the precursor body a step-by-step movement further provides to:

move said forming station in a return stroke in order to return to the respective starting point, during said step of moving the forming station in the return stroke such station remaining in the respective open position, and/or move the packaging station in a return stroke in order to return to the respective starting point or to a new starting point, during said step of moving the packaging station in the return stroke such station remaining in the respective closed condition, wherein at least one longitudinal portion of the precursor body is moved along the advancement path exclusively by the movement conferred to it by the forming station and the packaging station.

17. Process according to claim 16, wherein the step of conferring a step-by-step movement to the base film and the precursor body further comprises a step of stopping the precursor body and/or the base film by holding the base film and/or precursor body by a stop group active on the base film and/or the precursor body during said return strokes of the forming station and packaging station.

18. Process according to claim 16, wherein during the step of forming the predetermined number of tray-shaped elements, the forming station is in a closed position, in order to block a longitudinal segment of the base film with respect to the forming station, wherein, during the step of fixing said longitudinal segment of the closing film to the predetermined number of the tray-shaped elements, the packaging station is in said closed condition in order to block a segment of the precursor body and the closing film with respect to the packaging station.

19. Process according to claim 16, wherein said longitudinal portion of the precursor body is moved along said predetermined advancement path exclusively by the forming station and packaging station during the respective forward strokes of the stations themselves.

20. Process according to claim 16, wherein said longitudinal portion of the precursor body extends between the forming station and the packaging station when the forming and packaging station are starting the respective forward strokes along said predetermined advancement path.

21. Process according to claim 16, wherein the movement of the base film up to the forming station is exclusively conferred by the forming station and the packaging station themselves during the respective forward strokes.

22. Apparatus for packaging a product comprising:

a forming station configured for receiving a base film and forming by it a precursor body having a plurality of tray-shaped elements adjacent to each other, wherein the forming station comprises:

at least one upper portion, and at least one lower portion, the upper portion and lower portion being coupled to be movable with respect to each other between an open position of the forming station, wherein the upper portion and lower portion are spaced from each other and enable a longitudinal segment of the base film to enter the forming station, and a closed portion of the forming station, wherein the upper portion and lower portion are approached to each other for blocking said longitudinal segment of the base film with respect to the forming station and forming in such longitudinal segment one or more of said tray-shaped elements, a packaging station configured for receiving said precursor body and a closing film, the packaging station being configured for fixing the closing film to the precursor body at least at an upper opening of a predetermined number of said tray-shaped elements for forming packages flanked to each other, the packaging station, comprising in turn:

a lower tool comprising a predetermined number of seats each configured for receiving at least one of said tray-shaped elements, and an upper tool facing the lower tool and configured for cooperating with the lower tool for fixing at least a portion of said closing film to one or more tray-shaped elements placed in said seats, wherein the upper tool and lower tool are movable with respect to each other between an open condition of the packaging station, wherein the upper tool and lower tool are spaced from each other and enable to place one or more tray-shaped elements in said seats and to place said closing film portion above one or more respective tray-shaped elements, and a closed condition of the packaging station, wherein the upper tool and lower tool are approached to each other for blocking the one or more tray-shaped elements in said seats with respect to the packaging station and fixing said closing film portion to such one or more respective tray-shaped elements present in said seats, at least one movement device configured for moving, along a predetermined advancement path of said precursor body, at least one of said forming station and packaging stations, a control unit active on said forming station and packaging stations and also on the movement device, and configured for:

commanding a movement of the forming station between the respective open position and the respective closed position, commanding a movement of the packaging station between the respective open condition and the respective closed condition, commanding the movement device to perform at least one of the following:

a displacement of the forming station along said predetermined advancement path at least when the forming station is in said closed position, a displacement of the packaging station along said predetermined advancement path at least when the packaging station is in said closed condition, coordinating the movement of the forming station between the respective open position and the respective closed position, with the movement of the packaging station between the respective open condition and the respective closed condition, and with said at least one displacement performed by the movement device for conferring—to at least one longitudinal portion of the precursor body—a discontinuous step-by-step movement along said predetermined advancement path comprising at least one stop group configured for acting on at least one of:

said base film, the precursor body formed by the forming station, said packages formed by the packaging station, the stop group being further configured for being placed between at least one release condition, wherein it enables to move the precursor body or, respectively, said packages along the advancement path, and a gripping condition, wherein the stop group acts on the precursor body or, respectively, on said packages, by preventing them a movement along the advancement path;

said control unit being configured for commanding the stop group to be placed and remain in said closed condition when forming station is in said open position and/or when said packaging station is in said open condition, wherein said stop group comprises:

a first stop group active on said precursor body and operating in an area comprised between said forming station and said packaging station, or active on said base film and operating upstream the forming station, and a second stop group active on said precursor body and operating in an area comprised between said forming station and said packaging station, or active on said packages downstream the packaging station, said control unit being configured for commanding the first and second stop groups to be substantially simultaneously placed and remain both in said gripping condition when said forming station is in said open position and/or when said packaging station is in said open condition.

23. Apparatus according to claim 22, comprising:

a marking member capable of making on said base film or on the precursor body at least one reference notch, optionally wherein said marking member comprises a punch or knife which is configured for acting on the base film or precursor body by making said reference notch, and/or a cutting unit configured for transversally and/or longitudinally separating said packages in units distinct from each other, each comprising one or more tray elements, wherein the cutting unit is configured for cuttingly acting on the precursor body and/or the closing film applied to it, and/or a piercing unit provided with a piercing tool capable of displacing from a rest condition, in which it is spaced from the precursor body, and an operative condition wherein the piercing tool acts on said precursor body by performing at least one through opening on a wall, optionally a lateral wall, of a respective tray-shaped element.

24. Apparatus according to claim 23, wherein the first stop group comprises the piercing unit which, at the gripping condition of the first stop group, is configured for acting on the precursor body by making said at least one of said through openings, or wherein the first stop group comprises the marking member which, at the gripping condition of the first stop group is configured for acting on the base film or on the precursor body by making said reference notch, and/or wherein the second stop group comprises the cutting unit configured for cuttingly acting on the precursor body and/or on the closing film applied to it when the second stop group is in said gripping condition.

* * * * *